US012578152B2

(12) United States Patent
Robertson et al.

(10) Patent No.: US 12,578,152 B2
(45) Date of Patent: Mar. 17, 2026

(54) THERMAL ENERGY STORAGE SYSTEM

(71) Applicant: Wellhead Power Solutions, LLC, Sacramento, CA (US)

(72) Inventors: Andrew Cameron Robertson, Fresno, CA (US); Harold Edwin Dittmer, Sacramento, CA (US); Gary Alan Franzen, El Dorado Hills, CA (US); Timothy Michael Mann, Yuba City, CA (US)

(73) Assignee: Wellhead Power Solutions, LLC, Sacramento, CA (US)

( * ) Notice: Subject to any disclaimer, the term of this patent is extended or adjusted under 35 U.S.C. 154(b) by 869 days.

(21) Appl. No.: 17/900,646

(22) Filed: Aug. 31, 2022

(65) Prior Publication Data

US 2023/0086892 A1 Mar. 23, 2023

Related U.S. Application Data

(60) Provisional application No. 63/282,041, filed on Nov. 22, 2021, provisional application No. 63/246,884, filed on Sep. 22, 2021.

(51) Int. Cl.
*F28D 20/00* (2006.01)

(52) U.S. Cl.
CPC .. *F28D 20/0056* (2013.01); *F28D 2020/0078* (2013.01)

(58) Field of Classification Search
CPC ..... F28D 20/0056; F28D 2020/0078; F28F 2013/008; Y02E 60/14
See application file for complete search history.

(56) References Cited

U.S. PATENT DOCUMENTS 3,231,015 A 1/1966 Koch
3,624,356 A 11/1971 Havill
(Continued)

FOREIGN PATENT DOCUMENTS

AU 2016100490 A4 5/2016
CN 2055584 U 4/1990
(Continued)

OTHER PUBLICATIONS

Alzoubi M.F., et al., "Modeling of Compression Curves of Phase Change Graphite Composites Using Maxwell and Kelvin Models," Journal of Composite Materials, vol. 50, No. 8, Abstract, May 2015, 5 pages.

(Continued)

*Primary Examiner* — Robert G Bachner
(74) *Attorney, Agent, or Firm* — The Marbury Law Group, PLLC

(57) ABSTRACT

Various embodiments include a thermal storage system for storing energy in a graphite thermal storage structure and a thermal shutter assembly configured to control the transmission of heat from the graphite thermal storage structure to a thermal energy receiver, such as a heat exchanger or material processing crucible. A thermal storage block, which may be made of graphite, may be isolated by insulation except for the thermal shutter assembly. Energy may be stored in the graphite thermal storage block by applying energy to the block to raise its temperature to maximum operation temperature. Stored energy may then be harvested in a controlled manner by a control system actuating the thermal shutter to expose the thermal energy receiver to thermal radiation.

15 Claims, 20 Drawing Sheets

(56) References Cited

U.S. PATENT DOCUMENTS

| | | | |
|---|---|---|---|
| 3,868,170 | A | 2/1975 | Deluca |
| 4,134,451 | A | 1/1979 | Conant et al. |
| 4,136,276 | A | 1/1979 | Ashe |
| 4,164,457 | A | 8/1979 | Barnert et al. |
| 4,711,854 | A | 12/1987 | Pregnall et al. |
| 4,966,226 | A | 10/1990 | Hamburgen |
| 5,074,283 | A | 12/1991 | Beatty et al. |
| 6,519,951 | B2 | 2/2003 | Ovshinsky et al. |
| 6,729,269 | B2 | 5/2004 | Ott et al. |
| 6,746,771 | B2 | 6/2004 | Öttinger et al. |
| 7,033,570 | B2 | 4/2006 | Weimer et al. |
| 7,074,490 | B2 | 7/2006 | Feng et al. |
| 7,115,247 | B2 | 10/2006 | Zhao et al. |
| 7,175,751 | B2 | 2/2007 | Venkatesan et al. |
| 7,235,301 | B2 | 6/2007 | Bacher et al. |
| 7,704,405 | B2 | 4/2010 | Öttinger et al. |
| 7,803,426 | B2 | 9/2010 | Colibaba-Evulet |
| 7,858,876 | B2 | 12/2010 | Lagally et al. |
| 7,923,112 | B2 | 4/2011 | Christ et al. |
| 8,056,341 | B2 | 11/2011 | Hamer et al. |
| 8,171,984 | B2 | 5/2012 | Christ et al. |
| 8,272,431 | B2 | 9/2012 | Campagna et al. |
| 8,580,171 | B2 | 11/2013 | Christ et al. |
| 8,707,947 | B2 | 4/2014 | Hollis et al. |
| 8,791,357 | B2 | 7/2014 | Brown et al. |
| 9,052,122 | B2 | 6/2015 | Glynn et al. |
| 9,115,937 | B2 | 8/2015 | Perryman |
| 9,193,588 | B2 | 11/2015 | Bommaraju |
| 9,222,704 | B2 | 12/2015 | McAlister |
| 9,346,675 | B2 | 5/2016 | Bhattacharjee et al. |
| 9,362,576 | B2 | 6/2016 | Suyama et al. |
| 9,467,088 | B2 | 10/2016 | Matsumoto |
| 9,501,112 | B2 | 11/2016 | Nelson et al. |
| 9,540,957 | B2 | 1/2017 | Shinnar et al. |
| 9,683,299 | B2 | 6/2017 | McAlister |
| 9,705,449 | B2 | 7/2017 | Yazawa et al. |
| 9,929,690 | B2 | 3/2018 | Lenert et al. |
| 10,011,910 | B2 | 7/2018 | Phillips |
| 10,081,874 | B2 | 9/2018 | Zhu et al. |
| 10,093,843 | B2 | 10/2018 | Eliyahu et al. |
| 10,094,032 | B2 | 10/2018 | Hansen |
| 10,113,810 | B2 | 10/2018 | Parkinson et al. |
| 10,203,134 | B2 | 2/2019 | Johnson et al. |
| 10,214,820 | B2 | 2/2019 | Koeneman et al. |
| 10,345,050 | B2 | 7/2019 | Pietsch et al. |
| 10,407,780 | B2 | 9/2019 | Murahara |
| 10,465,995 | B1 | 11/2019 | Henry |
| 10,519,051 | B2 | 12/2019 | Fahs et al. |
| 10,535,904 | B2 | 1/2020 | Retti |
| 2003/0205482 | A1 | 11/2003 | Allen |
| 2004/0038119 | A1 | 2/2004 | Henze |
| 2006/0060464 | A1 | 3/2006 | Chang |
| 2006/0068205 | A1 | 3/2006 | Potier |
| 2007/0077478 | A1 | 4/2007 | Nguyen et al. |
| 2007/0224425 | A1 | 9/2007 | Christ et al. |
| 2008/0190781 | A1 | 8/2008 | Huang |
| 2008/0318050 | A1 | 12/2008 | Baumann |
| 2009/0074954 | A1 | 3/2009 | Weber et al. |
| 2009/0078568 | A1 | 3/2009 | Ramaswami et al. |
| 2009/0294092 | A1 | 12/2009 | Bahl et al. |
| 2010/0101955 | A1 | 4/2010 | Nocera et al. |
| 2010/0116457 | A1 | 5/2010 | Öttinger et al. |
| 2010/0186794 | A1 | 7/2010 | Chen et al. |
| 2010/0314081 | A1* | 12/2010 | Reis ..... F28F 21/02 165/134.1 |
| 2011/0120669 | A1 | 5/2011 | Hunt |
| 2012/0080161 | A1 | 4/2012 | Kelly |
| 2012/0102953 | A1 | 5/2012 | Davidson |
| 2012/0104766 | A1 | 5/2012 | Davidson |
| 2012/0138849 | A1 | 6/2012 | Palomo Del Barrio et al. |
| 2012/0312292 | A1 | 12/2012 | Bahl et al. |
| 2013/0264023 | A1 | 10/2013 | Hudler et al. |
| 2015/0082792 | A1 | 3/2015 | Bain et al. |
| 2015/0256119 | A1 | 9/2015 | Datas Medina et al. |
| 2016/0141225 | A1 | 5/2016 | Roemmler |
| 2016/0209124 | A1 | 7/2016 | Da Silvaa et al. |
| 2016/0298915 | A1 | 10/2016 | Bhargava |
| 2016/0355411 | A1 | 12/2016 | Fahs, II |
| 2017/0030656 | A1 | 2/2017 | Lien et al. |
| 2018/0094180 | A1 | 4/2018 | Prebe et al. |
| 2018/0106165 | A1 | 4/2018 | Barmeier |
| 2018/0159459 | A1 | 6/2018 | Mills |
| 2020/0088473 | A1 | 3/2020 | Warburton et al. |
| 2020/0278156 | A1* | 9/2020 | D'Arcy ..... F24F 12/002 |
| 2021/0143446 | A1 | 5/2021 | Ponec et al. |
| 2021/0215436 | A1 | 7/2021 | D'Arcy et al. |

FOREIGN PATENT DOCUMENTS

| | | | |
|---|---|---|---|
| CN | 2286857 | Y | 7/1998 |
| CN | 1050189 | C | 3/2000 |
| CN | 2594280 | Y | 12/2003 |
| CN | 1776341 | A | 5/2006 |
| CN | 2804775 | Y | 8/2006 |
| CN | 2826350 | Y | 10/2006 |
| CN | 1294229 | C | 1/2007 |
| CN | 102006022949 | A1 | 11/2007 |
| CN | 201066245 | Y | 5/2008 |
| CN | 100427563 | C | 10/2008 |
| CN | 102007047330 | A1 | 4/2009 |
| CN | 201441910 | U | 4/2010 |
| CN | 101526317 | B | 7/2010 |
| CN | 101915465 | A | 12/2010 |
| CN | 101928952 | A | 12/2010 |
| CN | 201764881 | U | 3/2011 |
| CN | 101294778 | B | 6/2011 |
| CN | 202032909 | U | 11/2011 |
| CN | 101738131 | B | 12/2011 |
| CN | 102374812 | A | 3/2012 |
| CN | 101805591 | B | 7/2012 |
| CN | 202304573 | U | 7/2012 |
| CN | 202547430 | U | 11/2012 |
| CN | 102809320 | A | 12/2012 |
| CN | 103646976 | A | 3/2014 |
| CN | 203464819 | U | 3/2014 |
| CN | 103940104 | A | 7/2014 |
| CN | 203744756 | U | 7/2014 |
| CN | 203744814 | U | 7/2014 |
| CN | 104018176 | A | 9/2014 |
| CN | 104048504 | A | 9/2014 |
| CN | 203839391 | U | 9/2014 |
| CN | 203840255 | U | 9/2014 |
| CN | 203848525 | U | 9/2014 |
| CN | 102849729 | B | 11/2014 |
| CN | 104164218 | A | 11/2014 |
| CN | 204007258 | U | 12/2014 |
| CN | 102903769 | B | 1/2015 |
| CN | 204131464 | U | 1/2015 |
| CN | 104388049 | A | 3/2015 |
| CN | 104539224 | A | 4/2015 |
| CN | 103289654 | B | 7/2015 |
| CN | 104845591 | A | 8/2015 |
| CN | 103574987 | B | 9/2015 |
| CN | 104930483 | A | 9/2015 |
| CN | 204809240 | U | 11/2015 |
| CN | 105222622 | A | 1/2016 |
| CN | 204963625 | U | 1/2016 |
| CN | 205048768 | U | 2/2016 |
| CN | 103289655 | B | 3/2016 |
| CN | 105423778 | A | 3/2016 |
| CN | 105602531 | A | 5/2016 |
| CN | 205228228 | U | 5/2016 |
| CN | 205228251 | U | 5/2016 |
| CN | 205332567 | U | 6/2016 |
| CN | 105839131 | A | 8/2016 |
| CN | 105928402 | A | 9/2016 |
| CN | 104131309 | B | 10/2016 |
| CN | 106017145 | A | 10/2016 |
| CN | 106242570 | A | 12/2016 |
| CN | 106318328 | A | 1/2017 |
| CN | 205909713 | U | 1/2017 |
| CN | 205909714 | U | 1/2017 |
| CN | 106433577 | A | 2/2017 |
| CN | 106440905 | A | 2/2017 |

(56) References Cited

FOREIGN PATENT DOCUMENTS

| | | | |
|---|---|---|---|
| CN | 205965246 | U | 2/2017 |
| CN | 106543969 | A | 3/2017 |
| CN | 206037768 | U | 3/2017 |
| CN | 106634856 | A | 5/2017 |
| CN | 106702415 | A | 5/2017 |
| CN | 106813519 | A | 6/2017 |
| CN | 206291754 | U | 6/2017 |
| CN | 107014224 | A | 8/2017 |
| CN | 107218832 | A | 9/2017 |
| CN | 107338026 | A | 11/2017 |
| CN | 107345773 | A | 11/2017 |
| CN | 206724769 | U | 12/2017 |
| CN | 106052451 | B | 1/2018 |
| CN | 107673759 | A | 2/2018 |
| CN | 107740133 | A | 2/2018 |
| CN | 105810812 | B | 3/2018 |
| CN | 207095357 | U | 3/2018 |
| CN | 105428348 | B | 4/2018 |
| CN | 107986721 | A | 5/2018 |
| CN | 108003843 | A | 5/2018 |
| CN | 207422956 | U | 5/2018 |
| CN | 106452287 | B | 6/2018 |
| CN | 108329894 | A | 7/2018 |
| CN | 207664150 | U | 7/2018 |
| CN | 207779195 | U | 8/2018 |
| CN | 108587572 | A | 9/2018 |
| CN | 108831947 | A | 11/2018 |
| CN | 109183066 | A | 1/2019 |
| CN | 208333173 | U | 1/2019 |
| CN | 208443246 | U | 1/2019 |
| CN | 208458553 | U | 2/2019 |
| CN | 109631649 | A | 4/2019 |
| CN | 208688304 | U | 4/2019 |
| CN | 106817880 | B | 5/2019 |
| CN | 208920934 | U | 5/2019 |
| CN | 109880597 | A | 6/2019 |
| CN | 208955155 | U | 6/2019 |
| CN | 110066643 | A | 7/2019 |
| CN | 209101858 | U | 7/2019 |
| CN | 209101873 | U | 7/2019 |
| CN | 110131575 | A | 8/2019 |
| CN | 209210214 | U | 8/2019 |
| CN | 209545466 | U | 10/2019 |
| CN | 110425920 | A | 11/2019 |
| CN | 209689455 | U | 11/2019 |
| CN | 108322140 | B | 12/2019 |
| CN | 209726873 | U | 12/2019 |
| CN | 209744516 | U | 12/2019 |
| CN | 106220178 | B | 1/2020 |
| CN | 210036408 | U | 2/2020 |
| CN | 111019611 | A | 4/2020 |
| CN | 210426182 | U | 4/2020 |
| CN | 210458035 | U | 5/2020 |
| DE | 2720078 | C2 | 10/1982 |
| DE | 19937730 | C1 | 7/2000 |
| DE | 102009036831 | A1 | 2/2011 |
| DE | 102011001883 | A1 | 10/2012 |
| DE | 102011107802 | A1 | 1/2013 |
| DE | 102012209322 | A1 | 12/2013 |
| DE | 102017008942 | A1 | 3/2019 |
| EP | 0203213 | B1 | 8/1988 |
| EP | 0196548 | B1 | 10/1988 |
| EP | 1506346 | A1 | 2/2005 |
| EP | 2590238 | A2 | 5/2013 |
| EP | 2820367 | A1 | 1/2015 |
| EP | 2995700 | A1 | 3/2016 |
| EP | 3208566 | B1 | 5/2019 |
| EP | 3551956 | A1 | 10/2019 |
| EP | 3008012 | B1 | 3/2022 |
| FR | 3019884 | A1 | 10/2015 |
| FR | 3039561 | B1 | 7/2017 |
| GB | 913249 | A | 12/1962 |
| GB | 964465 | A | 7/1964 |
| GB | 2496092 | A | 5/2013 |
| IN | 246685 | | 12/2010 |
| JP | 2567113 | Y2 | 3/1998 |
| JP | H10238979 | A | 9/1998 |
| JP | 2004340558 | A | 12/2004 |
| JP | 2010132845 | A | 6/2010 |
| JP | 4628705 | B2 | 2/2011 |
| JP | 5002912 | B2 | 8/2012 |
| JP | 5343478 | B2 | 11/2013 |
| JP | 5830500 | B2 | 12/2015 |
| JP | 2017048265 | A | 3/2017 |
| JP | 2019137854 | A | 8/2019 |
| KR | 100364766 | B1 | 12/2002 |
| KR | 100512042 | B1 | 9/2005 |
| KR | 101183481 | B1 | 9/2012 |
| KR | 20140076083 | A | 6/2014 |
| KR | 101538643 | B1 | 7/2015 |
| MX | 2016009333 | A | 1/2018 |
| TW | I535891 | B | 6/2016 |
| TW | I604623 | B | 11/2017 |
| WO | 2006081965 | A1 | 8/2006 |
| WO | 2010043416 | A2 | 4/2010 |
| WO | 2011055305 | A2 | 5/2011 |
| WO | 2011055306 | A2 | 5/2011 |
| WO | 2011055307 | A2 | 5/2011 |
| WO | 2011124624 | A1 | 10/2011 |
| WO | 2011139964 | A1 | 11/2011 |
| WO | 2013061035 | A1 | 5/2013 |
| WO | 2013116220 | A1 | 8/2013 |
| WO | 2014036738 | A1 | 3/2014 |
| WO | 2015085357 | A1 | 6/2015 |
| WO | 2016091576 | A1 | 6/2016 |
| WO | 2018014363 | A1 | 1/2018 |
| WO | 2019140705 | A1 | 7/2019 |
| WO | 2020019055 | A1 | 1/2020 |
| WO | 2020087425 | A1 | 5/2020 |

OTHER PUBLICATIONS

Amy C., et al., "Thermal Energy Grid Storage Using Multi-Junction Photovoltaics," Energy & Environmental Science, 2019, vol. 12, pp. 334-343.

Antonov V.I., et al., "Use of Thermally Expanded Graphite for Protection of a Furnace Smelting Chamber," Metallurgist, vol. 52, No. 5-6, 2008, pp. 346-349.

Antora Energy, "Solid State Thermal Battery," Retrieved from https://arpa-e.energy.gov/technologies/projects/solid-state-thermal-battery, Sep. 18, 2018, 2 pages.

Atmane I., et al., "Defective Graphite and Its Decoration with Copper Oxide Nanoparticles Synthesized with Olive Leaf Extract for Electrochemical Water Splitting," Journal of Inorganic and Organometallic Polymers and Materials, 2019, vol. 29, Abstract, pp. 132-143.

Boudesocque N., et al., "Hydrogen Production by Thermal Water Splitting Using a Thermal Plasma," WHEC, Jun. 2006, 11 pages.

Canada Carbon, "Refractory Products and Crucibles," Retrieved from https://www.canadacarbon.com/refractory-products-crucibles, 2022, 4 pages.

"Carbon Reduction Ventures Pty Ltd—A New Generation in Energy," Graphite Storage Technology, Retrieved from http://www.carbonreduction.com.au/technology-2/technology/, 2022, 2 pages.

Chambers A., et al., "Hydrogen Storage in Graphite Nanofibers," Journal of Physical Chemistry B, 1998, vol. 102, No. 2, Abstract, pp. 4253-4256.

Chu J., "Sun in a box" would Store Renewable Energy for the Grid, MIT News, Retrieved from https://news.mit.edu/2018/liquid-silicon-store-renewable-energy-1206, Dec. 5, 2018, 7 pages.

Datas A., et al., "Thermionic-Enhanced Near-Field Thermophotovoltaics for Medium-Grade Heat Sources," Applied Physics Letters, Apr. 2019, vol. 114, No. 13, 21 pages.

De Luca C., "Design of a Graphite Based Thermal Energy Storage for Concentrated Solar Power Applications," Spectrum Research Repository, Aug. 31, 2017, 7 pages.

Delta, "Graphite Heat Exchangers," Retrieved from http://www.deltathx.com/product/graphite-heat-exchangers/, 2016, 5 pages.

Deokattey S., et al., "Hydrogen Production Using High Temperature Reactors: An Overview," Advances in Energy Research, 2013, vol. 1, No. 1, pp. 13-33.

(56) References Cited

OTHER PUBLICATIONS

"Design of Heat Exchangers made of Graphite and Silicon Carbide," GAB Neumann GmbH, 1965-2015, 2 pages.
Dhandayuthabani M., et al., "Investigation of Latent Heat Storage System Using Graphite Micro-Particle Enhancement," Journal of Thermal Analysis and Calorimetry, vol. 139, Aug. 5, 2019, 13 pages.
Energy Storage News, "Global news, analysis and opinion on Energy Storage Innovation and Technologies," Retrieved from https://www.energy-storage.news/, 2021, 11 pages.
Energy XPRT "Sigma—Model G-TUBE—Graphite Tube Heat Exchanger," From Graphite Equipments, Retrieved from https://www.energy-xprt.com/products/sigma-model-g-tube-graphite-tube-heat-exchanger-498589, 2022, 4 pages.
Equipnet: Marketplace, "Used Graphite Heat Exchangers," Retrieved from https://www.equipnet.com/category/heat-exchangers-condensers/graphite%20tube-43091/, 2022, 24 pages.
"Graphite Heat Exchanger," Graphicarb Porducts, Retrieved from https://www.graphicarb.com/graphiteheatexchanger.php, 2022, 8 pages.
Graphite India Ltd, "Impervious Graphite Heat Exchangers," 1983, 12 pages.
"Graphite Shell & Tube Type Heat Exchanger," Corrox Remedies Pvt. Ltd., Retrieved from https://www.corrox.in/graphite-shell-and-tube-heat-exchangers, 2022, 1 page.
Hailu G., "Seasonal Solar Thermal Energy Storage," Chapter Metrics Overview, Retrieved from https://www.Intechopen.com/chapters/63027, 2018, 33 pages.
"Home CEPIC, Specialist Since 1958," Retrieved from https://www.cepic.eu/en/home/, 2021, 13 pages.
Ibiden Co., Ltd, "Graphite Specialty," Ceramics | Products, Retrieved from https://www.ibiden.com/product/ceramics/merchandise/graphite/, 2022, 5 pages.
Kaneko H., et al., "Solar Rotary Reactor for Continuous H2 Production Using Two-Step Water Splitting Process," WHEC, Jun. 2006, 6 pages.
Kansetsu International Co.,Ltd., "Impervious Graphite heat exchanger," Retrieved from http://www.kansetu.co.jp/kic-product-graphite_HE_eng.htm on Nov. 20, 2022, 2 pages.
Lee S.Y., et al., "Thermal Characterization of Erythritol/Expanded Graphite Composites for High Thermal Storage Capacity," Carbon, vol. 68, Mar. 2014, Abstract, pp. 67-72.
Lin W., et al., "A Performance Analysis of Porous Graphite Foam Heat Exchangers in Vehicles," Applied Thermal Engineering, vol. 50, No. 1, Jan. 10, 2013, pp. 1201-1210.
Lynch G., et al., "Large Scale Energy Storage with Thermal Matrix Energy Storage," Nanotechnology, vol. 2, 2013, pp. 683-686.
Mason J.B., et al., "Pyrolysis and Its Potential Use In Nuclear Graphite Disposal," Nuclear Energy, vol. 39, No. 5, 2000, 8 pages.
Mehling H., et al., "Latent Heat Storage Using a PCM-Graphite Composite Material," 2000, 7 pages.
Mehling H., "Latent Heat Storage with a PCM-Graphite Composite Material: Experimental Results from the First Test Store," Phase Change Materials and Chemical Reactions for Thermal Energy Storage 6th Workshop, Nov. 2000, pp. 1-9.
Mersen, "Graphite Block Heat Exchangers," GAB Neumann, Retrieved from https://www.gab-neumann.com/block-heat-exchangers on Nov. 20, 2022, 9 pages.
Mersen, "Publications," Retrieved from https://www.mersen.com/publications on Nov. 20, 2022, 3 pages.
Mohan M., et al., "Hydrogen Storage in Carbon Materials—A review," Energy Storage, Mar. 12, 2019, Abstract, 3 pages.
MTPV Power Corporation, "MTPV Eblade—Semiconductor Technology," Retrieved from https://www.energy-xprt.com/products/mtpv-eblade-semiconductor-technology-736454, 2022, 5 pages.
Multitherm LLC, "Maximize Your Thermal Fluid Heating System," Retrieved from https://www.multitherm.com/technical_articles_ten_tips.html, 2018, 12 pages.
Murmura M.A., et al., "Methodologies for the Design of Solar Receiver/Reactors for Thermochemical Hydrogen Production," Processes, Mar. 2020, vol. 8, 25 pages.
Neograf™ Solutions, "SpreaderShield™ Heat Spreaders," Retrieved from https://neograf.com/products/thermal-management-solutions/egraf-spreadershield, 2022, 8 pages.
Omair Z., et al., "Ultraefficient Thermophotovoltaic Power Conversion by Band-Edge Spectral Filtering," PNAS, Applied Physical Sciences, Jul. 16, 2019, vol. 116, No. 31, pp. 15356-15361.
"Peak Energy: Storing Energy Using Graphite," Retrieved from http://peakenergy.blogspot.com/2008/02/storing- energy-using-graphite.html, 2008, 5 pages.
Perkins C., et al., "Likely Near-Term Solar-Thermal Water Splitting Technologies," International Journal of Hydrogen Energy, Dec. 2004, vol. 29, No. 15, Abstract, pp. 1587-1599.
Perret R., et al., "IV.I High-Temperature Thermochemical," DOE Hydrogen Program, FY 2005 Progress Report, 2005, pp. 377-388.
"Project Profile: High-Efficiency Thermal Storage System for Solar Plants," Office of Energy Efficiency & Renewable Energy, Retrieved from https://www.energy.gov/eere/solar/project-profile-high-efficiency-thermal-storage-system-solar-plants, 2013, 3 pages.
Purewal J., "Hydrogen Storage Materials," Purewal Thesis, 2010, Chapter 1, pp. 1-21.
Rozzi E., et al., "Green Synthetic Fuels: Renewable Routes for the Conversion of Non-Fossil Feedstocks into Gaseous Fuels and Their End Uses," Energies, vol. 13, No. 2, 2020, Abstract, 3 pages.
Schmitt R., et al., "PCM-Graphite Latent Heat Storage Systems for Industrial Process Heat Recovery," Advances in Science and Technology, vol. 74, Abstract, Oct. 2010, 3 pages.
Schultz K., et al., "Thermochemical Production of Hydrogen from Solar and Nuclear Energy," General Atomics, Apr. 14, 2003, 44 pages.
SGL Carbon, "Diabon® Graphite Shell and Tube Heat Exchanger," 2 pages.
Korean Intellectual Property Office, "International Preliminary Report on Patentability", issued in related International Patent Application No. PCT/US2022/044172, mailed on Apr. 4, 2024 (8 pages).
Sinograf, "Industrial Application of Graphite," Retrieved from https://www.sinograf.com/en/201/industrial-application-of-graphite, 2022, 7 pages.
"Stub Graphite Coating and Drying," Ore & Metals Publishing House, Retrieved from https://www.rudmet.com/news/1914/?language=en, Apr. 12, 2013, 4 pages.
Tian Y., et al., "A Review of Solar Collectors and Thermal Energy Storage in Solar Thermal Applications," Applied Energy, 2013, vol. 104, pp. 538-553.
Tokai Carbon, "Smelting and Lining," Retrieved from https://www.tokaicarbon.co.jp/en/products/cobex/ on Nov. 20, 2022, 3 pages.
Tsuji R., et al., "Water Electrolysis Using Flame-Annealed Pencil-Graphite Rods," ACS Sustainable Chemistry & Engineering, vol. 7, No. 6, Feb. 2019, 6 pages.
Wang N., et al., "The Investigation of Thermal Conductivity and Energy Storage Properties of Graphite/Paraffin Composites," Journal of Thermal Analysis and Calorimetry, vol. 107, Mar. 27, 2011, Abstract, pp. 949-954.
Wu J., et al., "Heat Transfer Characteristics of an Expanded Graphite/Paraffin PCM-Heat Exchanger Used in an Instantaneous Heat Pump Water Heater," Applied Thermal Engineering, vol. 142, Sep. 2018, pp. 644-655.
Xiao M., et al., "Thermal Performance of a High Conductive Shape-Stabilized Thermal Storage Material," Solar Energy Materials and Solar Cells, vol. 69, No. 3, Oct. 2001, Abstract, pp. 293-296.
Yegeubayevaa S.S., et al., "Electrochemical Method of Obtaining of Electric Current from Thermal Energy Using Graphite Electrodes," Acta Physica Polonica Series A, Aug. 2015, vol. 128, No. 2-B, pp. B-455-B-458.
Yildiz B., et al., "Efficiency of Hydrogen Production Systems Using Alternative Nuclear Energy Technologies," International Journal of Hydrogen Energy, vol. 31, 2006, pp. 77-92.
Yuan H.W., et al., "Mechanical and Thermal Properties of Cement Composite Graphite for Solar Thermal Storage Materials," Solar Energy, vol. 86, No. 11, Nov. 2012, pp. 3227-3233.
Zhang Z., et al., "Study on Paraffin/Expanded Graphite Composite Phase Change Thermal Energy Storage Material," Energy Conversion and Management, vol. 47, No. 3, Feb. 2006, Abstract, pp. 303-310.

(56) References Cited

OTHER PUBLICATIONS

Zibo Ouzheng Carbon Co., Ltd "Graphite Block," Retrieved from http://ozgraphite.com/productshow.php?cid=15&id=78 on 2022, 6 pages.

International Search Report and the Written Opinion of the International Searching Authority received from the Korean Intellectual Property Office in corresponding International Application No. PCT/US2022/044172 dated Jan. 10, 2023.

* cited by examiner

THERMAL ENERGY STORAGE SYSTEM

RELATED APPLICATIONS

This application claims the benefit of priority to U.S. Provisional Patent Application No. 63/246,884 entitled "Thermal Energy Storage System" filed Sep. 22, 2021 and to U.S. Provisional Patent Application No. 63/282,041 entitled "Thermal Energy Storage System" filed Nov. 22, 2021, the entire contents of both of which are incorporated herein by reference for all purposes.

BACKGROUND

With the growing deployment of renewable energy systems including solar array systems and wind turbine generators there is increasing need for energy storage technologies. A variety of battery technologies are in development, with some large-scale battery systems deployed. While batteries offer an efficient means for storing electrical energy, there are also needs for storing thermal energy, such as for generating steam for various energy and industrial purposes.

SUMMARY

Various embodiments include systems and methods for storing energy as thermal energy in a graphite structure and using the stored thermal energy in an efficient and practical manner. Various embodiments may include a thermal storage block, which may be made of graphite, that is thermally isolated by insulation except for a thermal shutter assembly that is operable to expose thermal radiation emitted by the graphite thermal storage block to a thermal energy receiver, such as a heat exchanger or material processing crucible. Energy may be stored in the graphite thermal storage block by applying energy to the block to raise the temperature of the block up to maximum operation temperature. Stored energy may then be harvested in a controlled manner by controlling actuation of the thermal shutter to expose thermal radiation to the thermal energy receiver. A control system may actuate the thermal shutter to achieve a range of target heating rates and target temperatures in the thermal energy receiver.

BRIEF DESCRIPTION OF THE DRAWINGS

The accompanying drawings, which are incorporated herein and constitute part of this specification, illustrate exemplary embodiments of the claims, and together with the general description given above and the detailed description given below, serve to explain the features of the claims.

DETAILED DESCRIPTION

Various embodiments will be described in detail with reference to the accompanying drawings. Wherever possible, the same reference numbers will be used throughout the drawings to refer to the same or like parts. References made to particular examples and implementations are for illustrative purposes, and are not intended to limit the scope of the claims.

Various embodiments include a thermal storage system for storing energy in a graphite thermal storage structure and a thermal shutter configure to control the transmission of heat from the graphite thermal storage structure to a thermal energy receiver, such as a heat exchanger or material processing crucible.

Graphite is an ideal material for storing energy in the form of heat energy due to its specific heat capacity and stability at high temperatures. By thermally isolating a block of graphite within a chamber that maintains a vacuum or inert gas (e.g., helium, argon or nitrogen) atmosphere that is thermally isolated by thermal insulation, energy pumped into the graphite block will be stored as heat. This stored energy can then be transferred to a thermal energy receiver (e.g., a thermionic power converter, heat exchanger, steam generator or crucible) by exposing the thermal energy receiver to black body radiant heat energy (i.e., infrared and visible light) emitted by the graphite storage block. To control the amount of energy applied to a thermal energy receiver (e.g., a thermionic power converter, heat exchanger, steam generator or crucible), various embodiments include a thermal shutter that is configured to incrementally permit some of the blackbody radiation emitted by the graphite thermal storage block to pass through to the thermal energy receiver. Control of the thermal shutter may be accomplished by a computing device executing control system functionality based on temperature data provided to the computing device by temperature sensors coupled to the thermal energy receiver and graphite storage block.

Figure 1A:
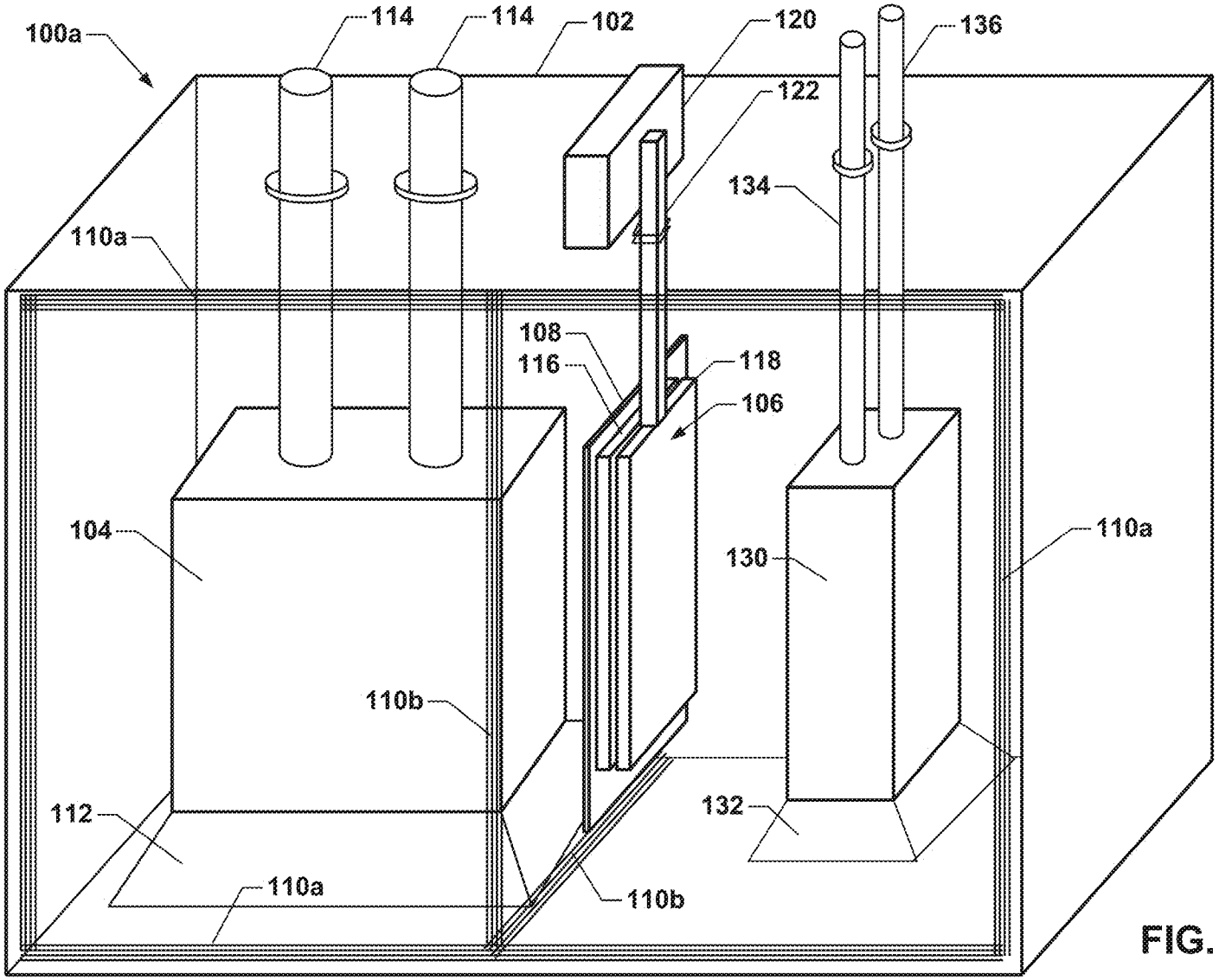
FIG. 1A is a perspective view of a system block diagram illustrating an example thermal storage system according to various embodiments.
Figure 1B:
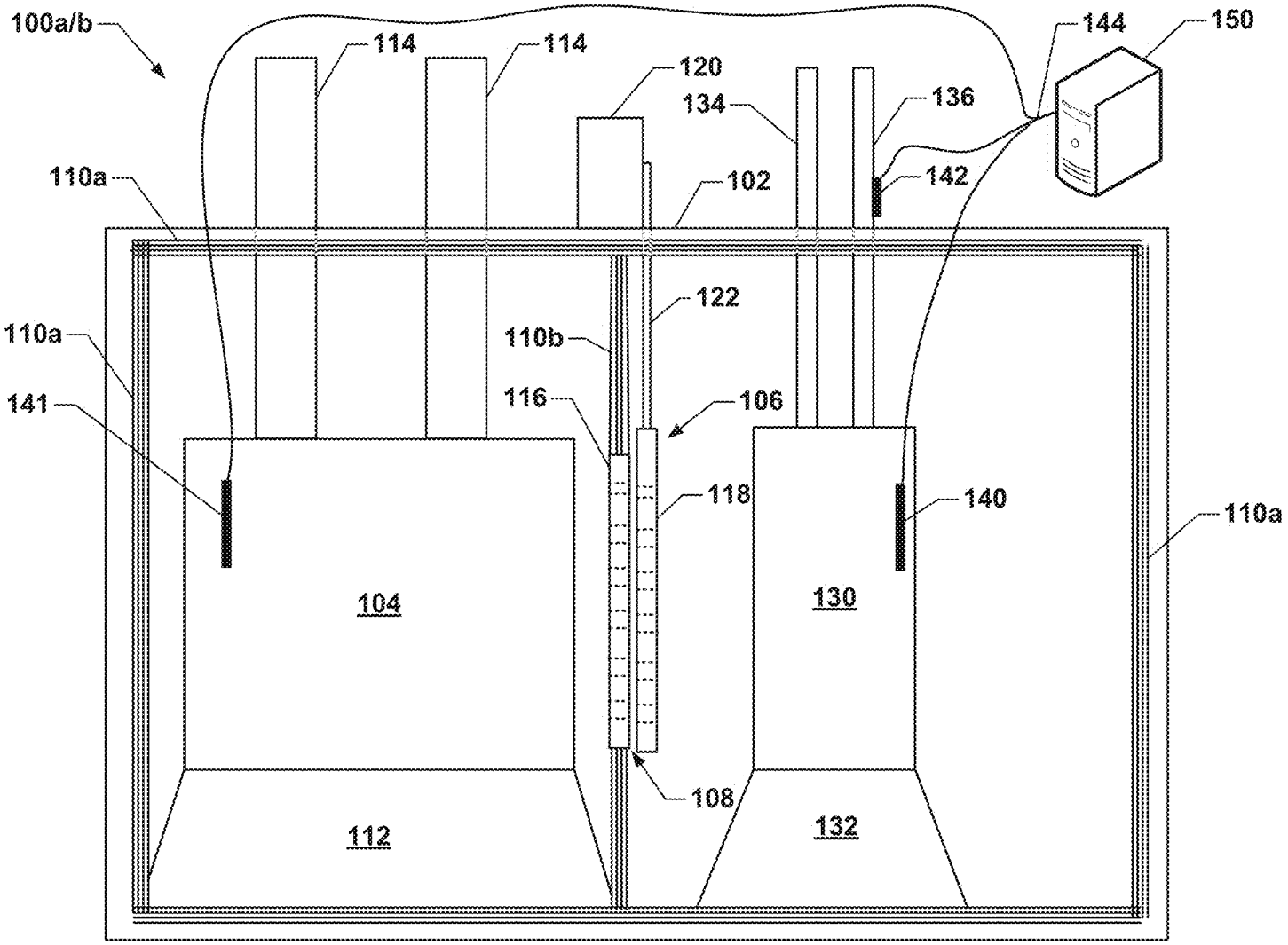
FIG. 1B is a side view of a system block diagram illustrating an example thermal storage system according to various embodiments.

FIG. 1A is a perspective block diagram and FIG. 1B is cross-sectional block diagram illustrating an example embodiment of a thermal storage system 100*a* showing representative major components. With reference to FIGS. 1A and 1B, in various embodiments, a thermal storage system 100*a* may include a chamber 102 that contains the thermal components in a vacuum or inert atmosphere (e.g., helium, argon, nitrogen, etc.). Such a chamber 102 may be configured with structural supports (e.g., graphite structures, refractory bricks, etc.) and with sufficient wall strength to support internal components as well as maintain vacuum, positive pressure (e.g., for an inert atmosphere) or reduced pressure within the chamber. To protect the structure of the chamber 102 and minimize leakage of thermal energy from within the chamber, interior walls of the chamber may be protected by high temperature thermal insulation 110*a* on all sides. As an example, the high temperature thermal insulation 110*a* may be formed through multiple layers of low thermal conductivity and low emissivity materials, such as graphite foil. In some embodiments, a cooling fluid (e.g., water, oil, gas, air, etc.) may be flowed through or adjacent to outer layers of the high temperature thermal insulation 110*a* to provide further thermal protection to the structures and/or the interior walls of the chamber 102.

Within the chamber 102, a thermal storage system 100*a* may include a graphite thermal storage block 104 that is situated and configured to store thermal energy by being raised to a very high temperature (e.g., 4000° F.), while enabling thermal energy to be harvested via blackbody radiant energy in a controlled manner. The thermal storage system 100*a* may include a thermal energy receiver 130 or crucible for holding materials to be thermally processed by radiant energy emitted by the graphite thermal storage block 104. In order to prevent thermal energy from reaching the thermal energy receiver 130 (or crucible) until needed, a thermal insulation barrier 110*b* may be included within the chamber 102 between the graphite thermal storage block 104 and the thermal energy receiver 130. Similar to the thermal insulation 110*a*, the thermal insulation barrier 110*b* may be formed through multiple layers of low thermal conductivity and low emissivity materials, such as graphite foil. To control the release of heat energy from the graphite thermal storage block 104, a thermal storage system 100*a* may include a thermal shutter 106 that is configured to control passage of radiant energy (e.g., infrared and visible light photons) through a window 108 in the thermal insulation barrier 110*b*. In some embodiments, cooling fluid (not shown) may be flowed through or adjacent to outer layers of the thermal insulation barrier 110*b* to provide further thermal protection to the structures of the thermal energy receiver 130.

In order to put energy into the graphite thermal storage block 104, any of a variety heating elements 114 may convey thermal energy (or other forms of energy such as electricity) from outside of the thermal storage system 100*a*, through the chamber 102 walls and thermal insulation 110*a* and into the graphite thermal storage block 104. Such heating elements 114 may be any of a variety of connectors or mechanisms for conveying thermal energy. Any known mechanisms for conveying heat into a block of graphite may be used for the heating elements 114 that inject thermal energy into the graphite thermal storage block 104.

In some embodiments, the heating elements 114 may be electrical resistance heaters connected to an external electrical power supply. Such electrical heating elements 114 may be coupled to or positioned within the graphite thermal storage block 104, with electrical conductors passing through the chamber 102 in thermally insulated ducts. In such embodiments, the heating elements 114 may be electrical resistance heaters configured to sustain high temperatures, such graphite-based resistance heaters.

In some embodiments, the heating elements 114 may be electrical conductors (e.g., graphite electrodes) connected to an external electrical power supply, electrically bonded to the graphite thermal storage block 104 and configured to drive externally supplied electricity through the graphite thermal storage block 104, thereby heating the graphite through electrical resistance. In such embodiments, the conductive nature of the graphite block results in the block itself functioning as an electrical resistive heater. In some embodiments, direct current (DC) electricity may be applied to electrodes that may be connected at opposite sides or ends of the graphite thermal storage block 104. In some embodiments, one-phase alternating current (AC) electricity may be applied to electrodes that may be connected at opposite sides or ends of the graphite thermal storage block 104. In some embodiments, three-phase AC electricity may be applied to three electrodes that may be connected at three separated locations in the graphite thermal storage block 104.

As another example, the heating elements 114 may be piping configured to convey a working fluid (e.g., steam, molten salt, liquid metal, or an inert gas) from an external heat source (e.g., a heat exchanger coupled to an energy source) into heat exchanger tubing (not shown) within the graphite thermal storage block 104.

While not shown in FIG. 1A, the heating elements 114 may include support structures (e.g., graphite structures, refractory bricks, etc.) for supporting the heating elements within the chamber and interfacing with the graphite thermal storage block 104. Further, the heating elements 114 may include thermal insulation and/or fluid cooling jackets, such as water-cooled cables, (neither of which are shown) as necessary to protect the elements from high temperatures that exist within the chamber 102 and high temperatures resulting from conductive heat transfer, as well as minimizing thermal leakage through the heating element structures.

As described in further detail herein, the thermal shutter 106 may be configured in a variety of ways that enable throttling and shutting off exposure to the thermal energy receiver 130 from thermal radiation (i.e., infrared light) emitted by the graphite thermal storage block 104. With reference to FIGS. 1A-2I, the thermal shutter 106 according to various embodiments described with reference to FIGS. 2A-2I may be formed from a single plate, a plurality of plates or similar structures formed of a high-temperature capable material (e.g., graphite) that exhibits low thermal conductivity and low emissivity (e.g., graphite foil), at least on an external surface. As illustrated in FIGS. 1A-1C and 5, the thermal shutter plate, plates or similar structures may be coupled to drive mechanisms configured to be moved (referred to herein as "actuated") to permit infrared and visible light to pass through the shutter to reach the thermal energy receiver 130 in an open configuration, and actuated to partially or totally block infrared and visible light from reaching the thermal energy receiver 130.

Figure 2A:
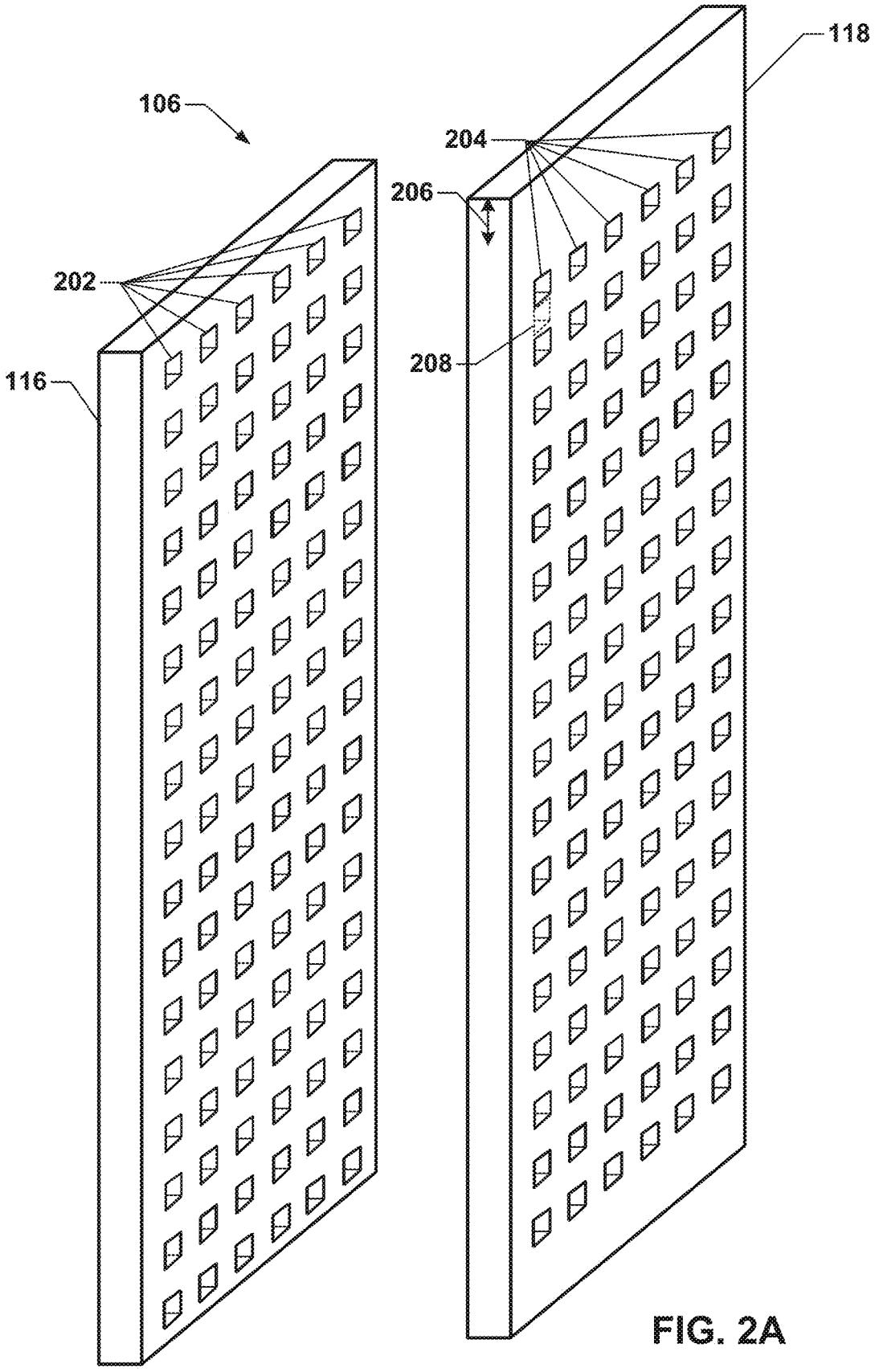
FIG. 2A is a perspective exploded view of an example configuration of a thermal shutter including two shutter elements according to some embodiments.

A nonlimiting example embodiment of the thermal shutter 106 illustrated in FIG. 1A includes a first graphite plate 116 positioned in the window 108 in the thermal insulation barrier 110*b* that includes a number of through-passages or openings to permit infrared and visible light to pass through the plate. As illustrated in FIGS. 1A, 1B, and 2A, as well as FIG. 5 described below, in this example embodiment the first graphite plate 116 is positioned adjacent to a second graphite plate 118 that is coupled to an actuator mechanism 120, such as by a connecting rod, leadscrew, ratchet shaft, a rack coupled to a pinion drive, etc., which are generally referred to herein as a driveshaft 122. The actuator mechanism and driveshaft 122, as well as the second graphite plate 118 and associated supports (e.g., sliding or bearing surfaces) are configured to enable the actuator mechanism 120 to move the second graphite plate 118 relative to the first graphite plate 116 either vertically or horizontally depending on the orientation of the system. The second graphite thermal plate 118 includes through-passages or openings similar to the through-passages or openings in the first plate 116. The first and second plates 116, 118 may be made of a low thermal conductivity graphite and faced with a low emissivity material (e.g., graphite foil) on the surface facing the graphite storage block 104 so as to minimize radiant heat transfer through the plates when the thermal shutter is in the closed position.

As described in more detail herein, by displacing the second graphite plate 118 with respect to the first graphite plate 116 via vertical or horizontal movements controlled by the actuator 120, the amount of thermal radiation reaching the thermal energy receiver 130 may be controlled. Specifically, controlled movements by the actuator 120 may cause the through-passages or openings in the second plate 118 to align with the through-passages or openings in the first plate 116 so as to permit thermal radiation emitted by the graphite thermal storage block 104 to reach the thermal energy receiver 130. Similarly, controlled movements by the actuator 120 may cause the through-passages or openings in the second plate 118 to not align with the through-passages or openings in the first plate 116 thus blocking thermal radiation emitted by the graphite thermal storage block 104 from reaching the thermal energy receiver 130 (or crucible).

While the embodiment illustrated in FIG. 1A and FIG. 2A shows the thermal shutter 106 including two plates, other configurations of the thermal shutter 106 may be used in the thermal storage system (e.g., 100*a*), some further examples of which are illustrated in and described herein with reference to FIGS. 2B-2I.

A thermal storage system (e.g., 100*a*) may also include structural components 112 (e.g., graphite structures, refractory bricks, etc.) for supporting the graphite thermal storage block 104, as well as structures 132 (e.g., graphite structures, refractory bricks, etc.) for supporting the thermal energy receiver 130 within the chamber 102. Such structures may be made of graphite to endure the high temperatures that can be maintained within the graphite thermal storage block 104 and the chamber 102.

The actuator 120 coupled by a driveshaft 122 to the second graphite plate 118 of the thermal shutter 106 may be any form of actuator mechanism. For example, the driving mechanism or motor within the actuator 120 may be electric, hydraulic, or pneumatic, and may move the second graphite thermal plate 118 using a rack and pinion mechanism, a drive screw or jackscrew that forms or is coupled to the driveshaft 122. Actuators 120 may include or be surrounded by thermal insulation (not shown separately) as necessary to protect the actuator components from high temperatures and heat that may leak from the chamber 102. While FIG. 1A shows the actuator 120 positioned on a top side of the chamber 102 actuating along a vertical axis, this is merely an example of one embodiment, and in other embodiments the actuator 120 may be positioned on a side of the chamber 102 actuating (i.e., displacing) the second graphite plate 118 along a horizontal axis, or on a bottom side of the chamber 102 actuating (i.e., displacing) the second graphite plate 118 along a vertical axis.

Any of a variety of thermal energy receivers 130 may be used in various implementation embodiments. As an example, the thermal energy receiver 130 may be a thermionic power converter. Thermionic power converters, which may also be referred to as thermionic generators, thermionic power generators and thermoelectric engines, include any of a class of devices that convert heat directly into electricity using thermionic emission, rather than requiring changing heat energy into another form of energy (e.g., steam or hot gas). In such embodiment applications, the overall system 100*a* may function as a power storage system, such as to store electrical energy when generated by an external source (e.g., via a solar or wind farm) but not fully consumed and deliver electrical energy when required to meet a demand when the external source is unable to satisfy the demand (e.g., at night or when there is no wind).

As another example, the thermal energy receiver 130 may be a heat exchanger configured to heat a working fluid (gas or liquid) that is directed to an external power converter or heat exchanger. For example, the working fluid may be a gas (e.g., helium, argon, nitrogen, air, etc.) that is heated in the thermal energy receiver 130 and then directed to a gas turbine, sterling engine or other heat engine to turn a turbine coupled to an electricity generator. Heated working fluids may be used for other purposes than powering a heat engine, such as heating buildings, thermal processing or melting materials, etc. Further, a fluid (e.g., molten salt, molten metal, pressurized water, etc.) heated in the heat exchanger thermal energy receiver may be used to heat another fluid (e.g., water) in a heat exchanger or steam generator located outside the chamber 102.

As another example, the thermal energy receiver 130 may be a steam generator configured to generate steam that is directed to an external steam turbine generator or to a system that uses steam for industrial uses, such as for thermal processing (e.g., processing food), heating (e.g., building heating systems), etc.

As another example, the thermal energy receiver 130 may be a crucible or similar structure configured to expose a material (e.g., metal, glass, ceramic, etc.) to high temperatures for thermal processing.

As illustrated in FIG. 1A, a thermal energy receiver 130 that is a heat exchanger or steam generator may include input lines 134 and output lines 136 by which the working fluid (e.g., water, air, inert gas, etc.) is directed into and returned out of the thermal energy receiver 130. Such input and output lines may include thermal insulation as necessary to protect piping from high temperatures that exist within the chamber 102 as well as minimizing thermal leakage through the thermal energy receiver 130 input and output lines 134, 136. In an embodiment application in which the thermal energy receiver 130 is a thermionic power converter, the input lines 134 and output lines 136 may be electrical cables for carrying electric power. In such embodiment applications, the input and output cables 134, 136 may include thermal insulation as necessary to protect the electrical cables from high temperatures that exist within the chamber 102 as well as minimizing thermal leakage through the cables. In some embodiments, thermal insulation provided to protect input and output cables 134, 136 may include passages for flowing cooling fluid through the insulation to provide further thermal protection for the cables.

The cross sectional block diagram in FIG. 1B shows more clearly how a thermal insulation barrier 110*b* may be positioned between the graphite thermal storage block 104 and the thermal energy receiver 130 (or a crucible), and include a thermal shutter 106 positioned within a window 108 through the barrier.

In some embodiments, the thermal energy receiver 130 may be movable and configured to be inserted into the chamber 102 for thermal processing, and removed from the chamber 102 between thermal processing sessions. Such embodiments may be useful for thermally treating of objects (e.g. finished parts), which may be more easily placed in and removed from a crucible outside of the chamber 102. In such applications, the thermal energy receiver 130 may be in the form of a crucible that is coupled to a drive mechanism configured to raise and lower the crucible or move the crucible horizontally into and out of the chamber 102. In such applications, the chamber 102 may include structures, similar to an airlock, that facilitates moving the thermal energy receiver 130 into and out of the chamber without substantial loss of thermal energy and/or inert gas (e.g., positive pressure or partial vacuum) maintained within the chamber.

Figure 2B:
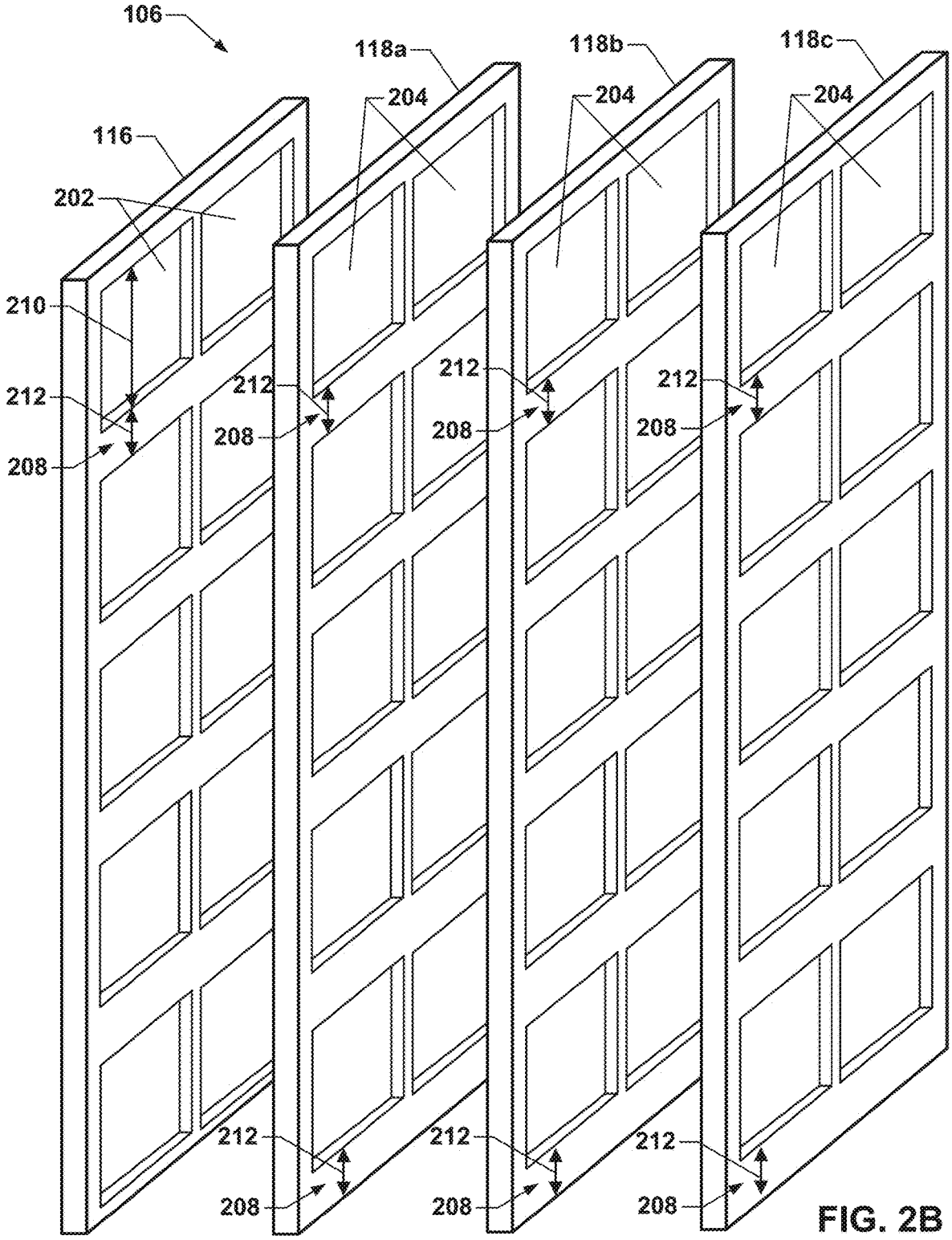
FIG. 2B is a perspective exploded view of an example configuration of a thermal shutter including four shutter elements according to some embodiments.

FIG. 1B also shows how the first graphite plate 116 and the second graphite thermal plate 118 may be positioned so that through-passages or holes (shown in dashed lines) may be lined up through vertical (or horizontal) movement of the second graphite thermal plate 118 by the actuator 120. Further descriptions of functioning of the thermal shutter are provided below with reference to FIGS. 4A and 4B. Again, FIG. 1B shows the thermal shutter 106 including two plates 116 and 118, in some embodiments, the thermal shutter 106 may include one plate (e.g., as illustrated in FIG. 2H) or more than two plates, such as three or four plates, with two or more plates configured to be actuated to control the amount of thermal radiation reaching the thermal energy receiver 130. Embodiments including more than two plates may include additional actuators to move two or more plates in tandem or independently to align or partially align through-passages or holes in the three or more plates.

Again, while FIG. 1B shows the actuator 120 positioned on a top side of the chamber 102 actuating along a vertical axis, this is merely an example of one embodiment, and in other embodiments the actuator 120 may be positioned on a side of the chamber 102 actuating along a horizontal axis, or on a bottom side of the chamber 102 actuating along a vertical axis.

FIG. 1B also shows that a thermal storage system 100*a* may include multiple temperature sensors 140, 141, 142 coupled (e.g., by data cables 144) to a computing device 150 of a control system. For example, a temperature sensor 140 (e.g., a thermoresistor or thermocouple) may be included within a thermal energy receiver 130 or crucible to provide heat operating temperature data to the computing device 150 of the control system. As another example, a temperature sensor 141 (e.g., a thermoresistor, thermocouple or pyrometer) may be included within or positioned near the graphite thermal storage block to provide operating temperature data to the computing device 150 of the control system. As another example, a temperature sensor 142 (e.g., a thermoresistor or thermocouple) may be included within or coupled to an outlet line 136 of the thermal energy receiver 130 to provide temperature data regarding the temperature of the working fluid exiting the thermal energy receiver 130.

In various embodiments computing device 150 of the control system may also be coupled to an external system or systems (not shown) that provides electrical energy for storage as thermal energy in the thermal storage system 100*a*, such as a wind turbine system, a solar array system, or a utility grid, and control power applied to the heating elements 114 as such power is available.

In embodiments in which thermal energy is added to the graphite thermal storage block 104 via electrical heaters, the computing device 150 of the control system may control power applied to the heating elements 114 as well as control the thermal shutter(s) 106, 106*a*-106*d* to control the amount of thermal energy stored in and harvested from the graphite thermal storage block 104. In some embodiments, the computing device 150 of the control system may control power applied to the heating elements 114 to maintain the graphite thermal storage block below a maximum operating temperature of about 4000 degrees Fahrenheit (4000° F.).

In embodiments in which thermal energy is added to the graphite thermal storage block 104 from thermal energy sources (e.g., industrial steam plants, solar collectors, gas turbine exhaust heat exchangers, etc.), the computing device 150 of the control system may control or throttle the amount of external heat applied to the graphite thermal storage block 104 as well as control the thermal shutter(s) 106, 106*a*-106*d* to control the amount of thermal energy stored in and harvested from the graphite thermal storage block 104. In some embodiments, the computing device 150 of the control system may control or throttle the amount of external heat applied to the graphite thermal storage block 104 to maintain the graphite thermal storage block below a maximum operating temperature of about 4000 degrees Fahrenheit (4000° F.).

In some embodiments, the computing device 150 of the control system may control thermal shutters 106, 106*a*-106*d* to maintain the graphite thermal storage block above a minimum operating temperature of about 2000 degrees Fahrenheit (2000° F.). Further, the computing device 150 of the control system may control thermal shutters 106, 106*a*-106*d* to maintain a thermal energy receiver 130 to maintain a target output temperature of the working fluid.

As an example, the computing device 150 of the control system may control thermal shutters 106, 106*a*-106*d* to irradiate a water-to-steam heat exchanger so that generated steam remains at a target output steam temperature of 500 degrees Fahrenheit (500° F.). In an example configuration suitable for applying heat to a water-to-steam heat exchanger, the graphite thermal storage block may have a mass of about 929,000 pounds and be shaped or configured to provide a thermal transfer rate to a water-to-steam heat exchanger of about 77 MMBtu/hour. Such a configuration is anticipated to capable of generating 60,000 pounds per hour (lb./hr.) of steam with an enthalpy of 1200 BTU/lb. for up to 12 hours before reheating of the graphite thermal storage block is required. In embodiments suitable for irradiating a water-to-steam heat exchanger, the computing device 150 of the control system may also be configured to control flow rates of water flowing through the heat exchanger to maintain a target output steam temperature considering the temperature of the graphite thermal storage block 104 (which changes as heat is extracted) and the temperature of the input water. For example, the computing device 150 may throttle water flow through the heat exchanger to maintain a constant desired steam temperature as energy is extracted from the graphite thermal storage block 104 over time.

Figure 1C:
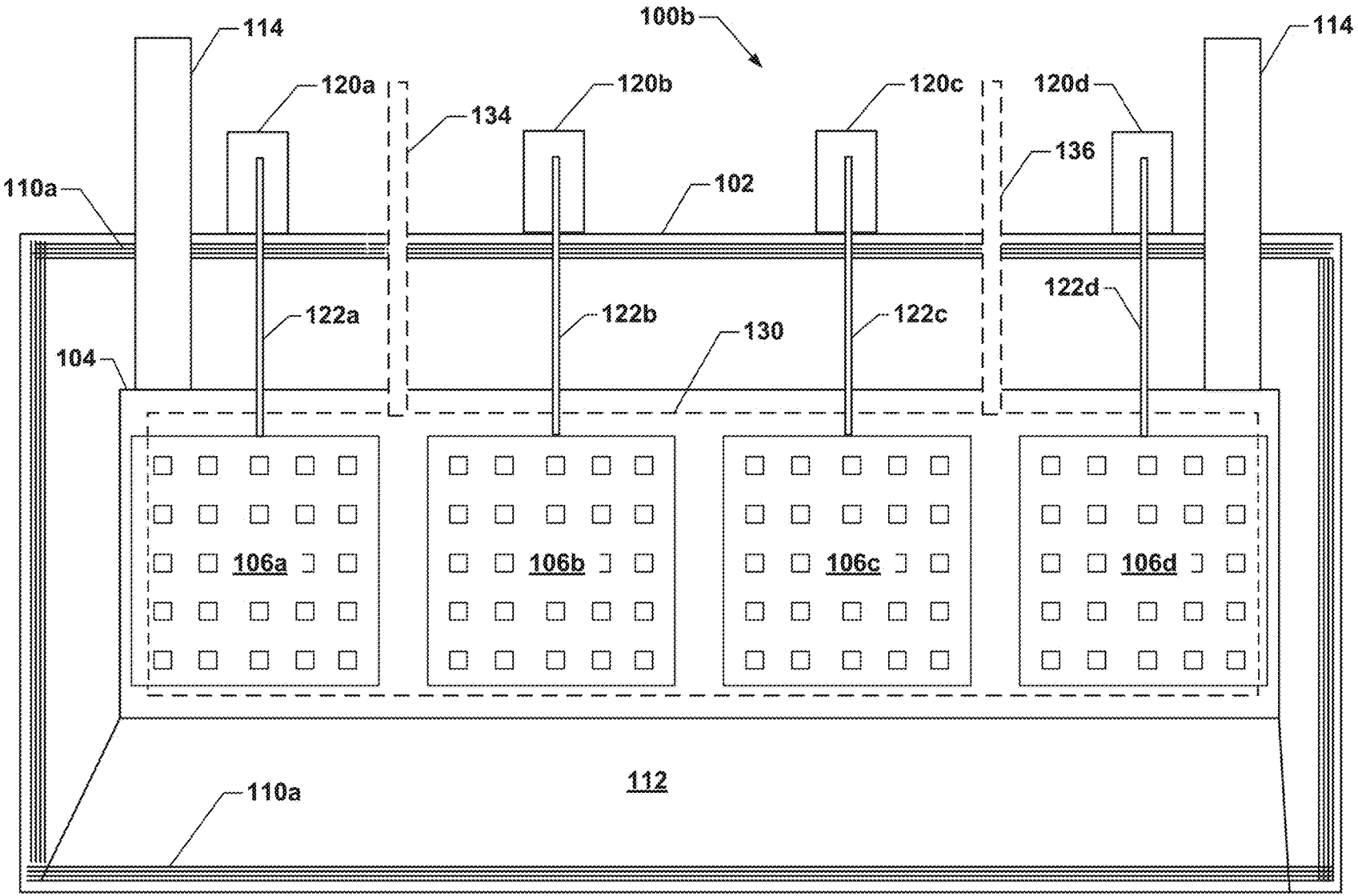
FIG. 1C is a cut-away frontal view of a system block diagram illustrating an example thermal storage system according to some embodiments.

In various embodiments, the graphite thermal storage block may be configured in a number of units or blocks to provide sufficient thermal storage mass and configuration or shape to support a variety of applications. FIG. 1C is a cross-sectional block diagram that illustrates another embodiment of a thermal storage system 100*b* in which the graphite thermal storage block 104 has an extended rectilinear shape. In this configuration, multiple thermal shutters 106*a*-106*d* may be positioned along the face of the graphite thermal storage block 104. Including multiple thermal shutters 106*a*-106*d* may enable enhanced throttling or control of the amount of thermal radiation that reaches the thermal energy receiver 130, which is shown in dashed lines in FIG. 1B in order to reveal details of the multiple thermal shutters 106*a*-106*d* and the graphite thermal storage block 104. In such a configuration, each thermal shutter 106*a*-106*d* may be connected to a dedicated driveshaft 122*a*-122*d* and controlled by a separate actuator 120*a*-120*d*.

In an example embodiment, a rectilinear graphite thermal storage block 104 may have dimensions of one foot (e.g., in thickness) by three feet (e.g., in height) by thirty feet (e.g., in length). In such an example embodiment, thermal shutters may be three feet by three feet with a total thickness of up to 1 foot. In this embodiment there may be up to ten thermal shutters 106 placed side-by-side along the length of the graphite thermal storage block. In this embodiment, the thermal energy receiver 130 may be oriented horizontally, with tubes carrying the working fluid (e.g., water and steam) extending 30 feet more or less in parallel to the graphite thermal storage block 104 and thermal shutters 106. In some embodiments, there may be two thermal energy receivers 130 (e.g., heat exchangers, steam generators, thermionic power converters, etc.) oriented horizontally and positioned on each side of the graphite block 104.

In some embodiments, an extended rectilinear thermal storage block 104 such as illustrated in FIG. 1C may have a short access cross-section similar to that illustrated in FIG. 1B. Thus, an example of positioning of the thermal energy receiver 130 with respect to the thermal shutters 106*a*-106*d* and graphite thermal storage block 104 of the embodiment illustrated in FIG. 1C is shown in FIG. 1B.

Figure 1D:
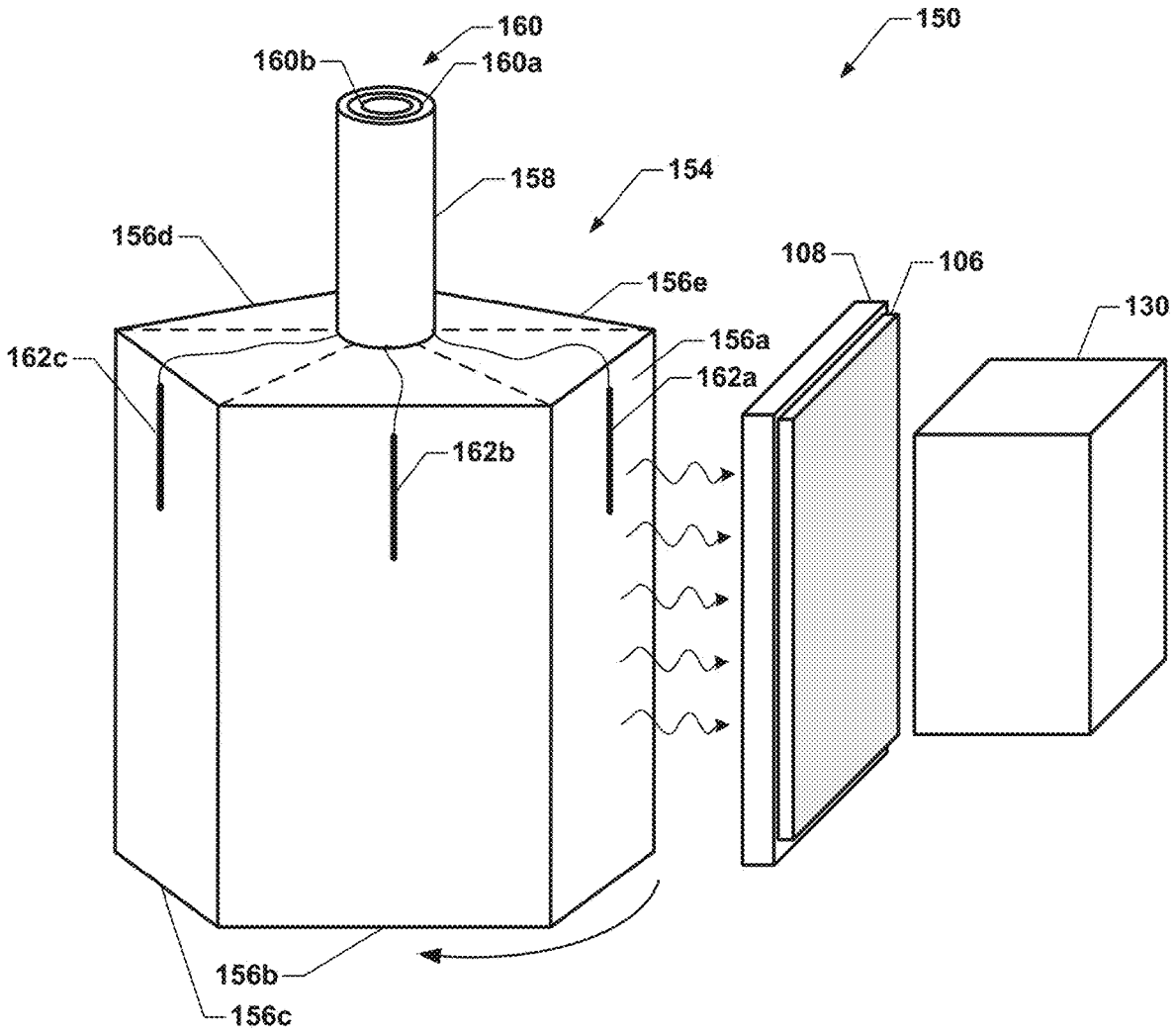
FIG. 1D is a perspective of portions of an example thermal storage system including a rotatable thermal storage block according to some embodiments.

FIG. 1D illustrates a further example embodiment in which the graphite thermal storage block 154 is configured to be rotated about a vertical axis so as to provide more consistent thermal radiation of the thermal energy receiver 130. As noted herein, as the graphite thermal storage block emits thermal energy, the temperature of the emitting surface of the block will decline, which will reduce the temperature and energy of the thermal radiation reaching the thermal energy receiver 130. A rotating thermal storage block 154 as illustrated in FIG. 1D may compensate for this decline in temperature and emitted energy by periodically rotating so as to bring a new face of the graphite thermal storage block before the window 108 and thermal shutter 106.

In the embodiment illustrated in FIG. 1D, the graphite thermal storage block 154 may be in the form of a multisided rectilinear block, with flat sides that are at least as large as the window 108 and thermal shutter 106. In the illustrated example, the graphite thermal storage block 154 has a pentagonal shape, thus providing five sides 156*a*-156*e* that can be positioned before the window 108 and thermal shutter 106 in sequence to apply heat to the thermal energy receiver 130 as the graphite thermal storage block 154 is rotated about a vertical axis.

In this embodiment, the graphite thermal storage block 154 may be supported or rotated by a vertical driveshaft 158. In some embodiments, the graphite thermal storage block 154 may be fully supported (i.e. suspended) by the vertical driveshaft 158. In some embodiments, the graphite thermal storage block 154 may be supported on a bottom surface by bearings or rollers (not shown), with rotational force only provided by the vertical driveshaft 158. In some embodiments, the graphite thermal storage block 154 may be partially supported on a bottom surface by bearings or rollers (not shown) and partially supported (i.e. suspended) by the vertical driveshaft 158. The vertical driveshaft 158 may be coupled to an external drive mechanism (not shown) positioned outside of the chamber 102, such as with sufficient insulation to protect the driving mechanism from the high temperature of the graphite thermal storage block 154 and interior of the chamber 102. In some embodiments, thermal insulation provided to protect the vertical drive shaft 158 may include passages for flowing cooling fluid through the insulation to provide further thermal protection for the drive shaft.

In such embodiments, the vertical driveshaft 158 may include electrical connections or fluid paths for bringing heat energy to the center of the graphite thermal storage block 154 while enabling rotation of the graphite thermal storage block 154. In some embodiments, the vertical driveshaft 158 may include concentric electrical conductors 160 that permit rotatable connections to external electrical power sources and connect to electrical heating elements within the graphite thermal storage block 154. For example, one concentric conductor 160*a* may be electrically connected to a top portion of the graphite thermal storage block 154 and a second concentric conductor 160*b* may be electrically connected to a bottom portion of the graphite thermal storage block 154, so that electricity provided by an external power source flows through the graphite thermal storage block 154, thereby heating the block due to the electrical resistance of the graphite. In this example, heat generated within the graphite thermal storage block 154 due to resistive heating the block from the inside while thermal energy is emitted from one of the faces (e.g. 156*a*) of the block that faces the window 108 and thermal shutter 106. Any of a variety of known rotatable electrical connections (e.g., brushes, conductive rollers, etc.) may be used to apply electricity to the concentric electrical conductors. In another embodiment, concentric fluid paths (e.g., concentric pipes) may be used to direct a heating fluid (e.g., molten salt, molten metal, etc.) into the graphite thermal storage block 154, which may be configured with internal fluid passages that enable the heating fluid to flow through the block from the top to the bottom, or the bottom to the top so as to heats a block from inside.

In some embodiments, temperature sensors 162*a*-162*c* may be positioned on or near each face 156*a*-156*e* to measure the temperature of the meeting surfaces. Such temperature sensors may be coupled to a control system 150 (see FIG. 1B) via connectors or cables that are routed through the vertical driveshaft 158 to the exterior of the chamber 102.

During a thermal treatment or while harvesting thermal energy, the graphite thermal storage block 154 may be rotated so that one of the faces 156*a*-156*e* (e.g., 156*a*) is facing the window 108 and thermal shutter 106, and the thermal shutter 106 may be opened to expose the thermal energy receiver 130 to radiant thermal energy. The control system 150 may monitor the surface temperature of the exposed face, such as by a monitoring temperature sensor (e.g., 162*a*) on or near that face. When the control system 150 determines that the surface temperature the exposed face falls to or below a threshold temperature for the thermal energy receiver 130, the control system may command an actuator (not shown) to apply a rotating force to rotate the graphite thermal storage block 154 to bring another face (e.g., 156*e*) into position before the window 108 and thermal shutter 106.

Figure 1E:
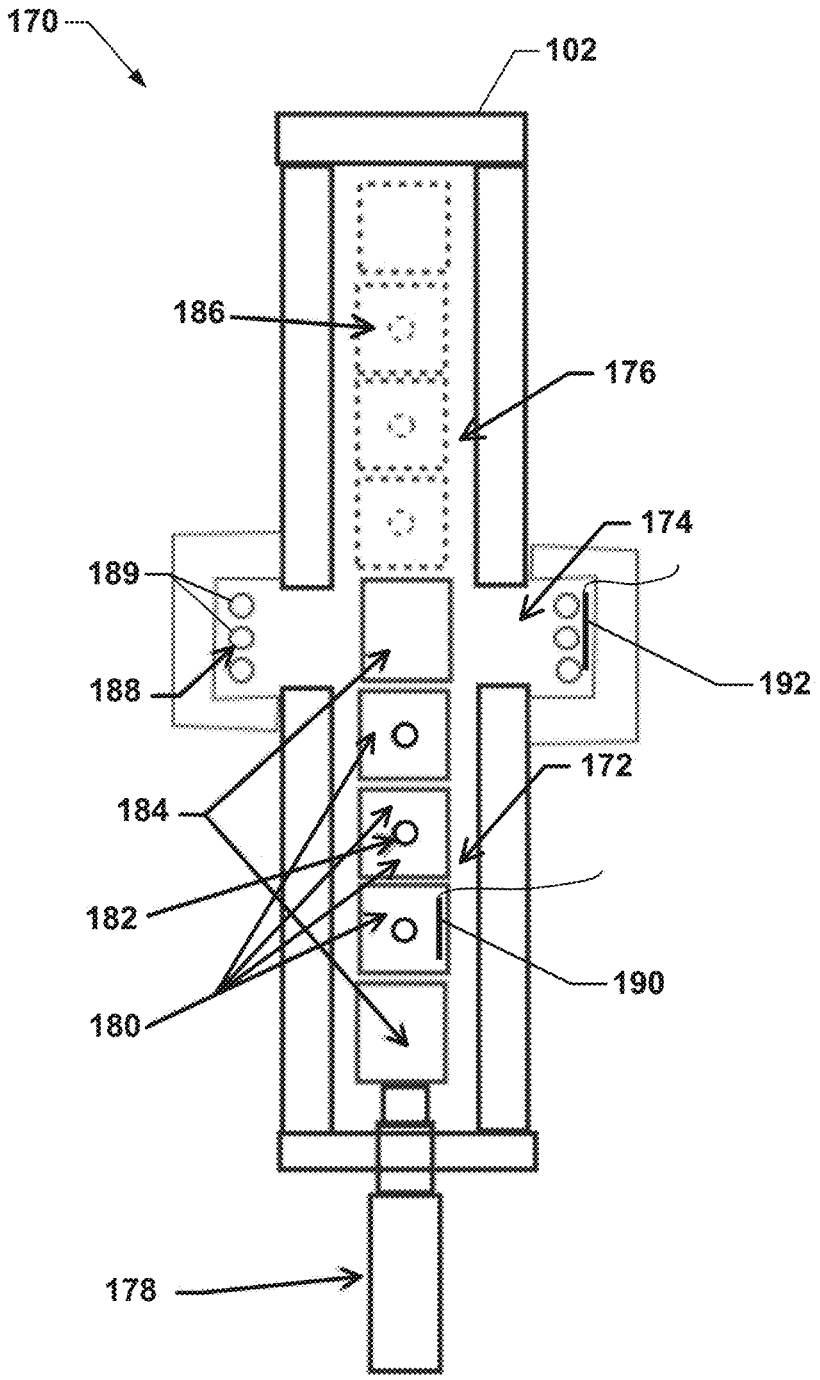
FIG. 1E is a cross-sectional view of a system block diagram illustrating an example thermal storage system including longitudinally moveable thermal storage blocks according to some embodiments.

FIG. 1E illustrates a further example embodiment of a graphite thermal storage system 170 in which a number of graphite thermal storage blocks 180 are configured in a vertical (or horizontal) stack within the chamber 102 with an actuator 178 configured to raise thermal storage blocks into a position at which stored heat energy can be released to a thermal energy receiver, such as a heat exchanger 188. In the embodiment illustrated in FIG. 1E, the chamber 102 may include a first subchamber 172, an exposure zone 174, and a second subchamber 176. A number of graphite thermal storage blocks 180 may be stacked within the chamber 102 and configured to be moved by one or more actuators 178 from one of the first or second subchambers, such as the first subchamber 172 as illustrated, through the exposure zone 174 in which thermal energy may be absorbed by a heat exchanger 188 or other type of thermal energy receiver, and then on to the other of the first or second subchambers, such as the second subchamber 176 as illustrated in dashed blocks 186. The cooled thermal storage blocks 186 may then be reheated (e.g., with electric heaters 182) before the process is reversed, moving the storage blocks from the second subchamber 176 through the exposure zone 174 sequentially to release thermal energy to the heat exchanger 188.

In this configuration, the graphite thermal storage blocks 180 may be multisided rectilinear blocks with a long axis much larger than the other two axes, with flat sides that are at least as large as the height of the exposure zone 174. In some embodiments, the exposure zone 174 may be toroidal in shape wrapping around the thermal storage blocks.

While the graphite thermal storage blocks 180 are positioned within either or both of the first or second subchambers 172, 176, thermal energy may be added to the graphite thermal storage blocks 180, such as via a heating element 182 (e.g., an electric heater) as described herein. To minimize thermal leakage when thermal harvesting is not happening, the stack of graphite thermal storage blocks 180 may include an insulating block 184 located at the top and bottom of the stack. The insulating block 184 may be configured with low emissivity materials on the surface to minimize absorption and emission of thermal energy. When the stack of graphite thermal storage blocks 180 and insulating blocks 184 is moved so that one of the graphite thermal storage blocks 180 is positioned at least partially within the exposure zone, the heat exchanger 188 receives thermal energy from the exposed thermal storage block. When the stack of graphite thermal storage blocks 180 and insulating blocks 184 is moved so that one of the insulating blocks 184 is positioned within the exposure zone 174 (as illustrated), thermal energy will be at least partially blocked from reaching the heat exchanger 188 or other type of thermal energy receiver.

The thermal energy receiver illustrated in FIG. 1E is a heat exchanger 188, but may be any form of thermal energy receiver described herein. In the case of a heat exchanger 188, heat exchanger tubes 189 carrying the working fluid may be oriented to run parallel to the long axis of the graphite thermal storage blocks 180. To provide even capture of thermal energy from the graphite thermal storage blocks 180, the heat exchanger tubes 189 may double back at one end so that the inlet and outlet of the heat exchanger 188 are positioned on the other end. In embodiments in which the exposure zone 174 is toroidal in shape wrapping around the thermal storage blocks, the heat exchanger tubes 189 may be helical in configuration wrapping around the inside of the toroidal exposure zone 174.

The one or more actuators 178 may be any of a variety of known drive mechanisms, including hydraulic lifts, hydraulic jacks, electric motors actuating leadscrews, electric jacks, etc. The one or more actuators 178 may also include insulation (not shown) configured to protect connecting structures and actuator mechanisms from high temperatures within the chamber 102. In some embodiments, thermal insulation provided to protect the one or more actuators 178 may include passages for flowing cooling fluid through the insulation to provide further thermal protection for the connecting structures and actuator mechanisms.

As noted herein, as the graphite thermal storage block emits thermal energy, the temperature of the emitting surface of the block will decline, which will reduce the temperature and energy of the thermal radiation reaching the heat exchanger 188. By sequentially lifting or lowering graphite thermal storage blocks 180 sequentially into the exposure zone 174, the embodiment thermal storage system 170 illustrated in FIG. 1E can provide approximately constant thermal heating of the heat exchanger 178. Further, graphite thermal storage blocks 180 within the first and/or second subsections 172, 176 can be reheated (e.g., via the heating elements 182) at the same time as one of the storage blocks positioned in the exposure zone 174, thus enabling harvesting of thermal energy concurrently with thermal energy storage.

In some embodiments, temperature sensors 190 may be positioned on or within graphite thermal storage blocks 180 to measure the temperature of the blocks, and/or temperature sensors 192 may be positioned within the exposure zone 174 to measure temperatures of or near elements of the heat exchanger 188 or other type of thermal energy receiver. Such temperature sensors 190, 192 may be coupled to a control system 150 (see FIG. 1B) via connectors or cables that are routed through the chamber 102 walls.

During a thermal treatment or while harvesting thermal energy, the stack of graphite thermal storage blocks 180 may be raised or lowered sufficient to position one block (or more than one block in some embodiments) within the exposure zone 174 to expose the heat exchanger 188 to radiant thermal energy. The control system 150 may monitor the surface temperature of the exposed graphite thermal storage block 180, such as by a monitoring temperature sensor 190 on or within the block and/or may monitor temperatures within the exposure zone 174 via temperatures sensors 192. When the control system 150 determines that the temperature of the exposed graphite thermal storage block 180 and/or within the exposure zone 174 falls to or below a threshold temperature for the heat exchanger 188, the control system may command the one or more actuators 178 to raise or lower one of the graphite thermal storage blocks 180 into the exposure zone 174, and raising or lowering the now-cooled block into one of the first or second subsections 176 where the block may be reheated.

While FIGS. 1A-1C show the graphite storage block 104 as a single unitary block, this is merely for illustration. In some embodiments, the graphite storage block 104, 154 may be segmented or made up of a number of smaller blocks that are assembled together. Segmenting the graphite storage block 104 may provide a number of manufacturing and thermal performance vantages. Manufacturing smaller blocks that can be assembled together to form the final large graphite storage block 104 may reduce the cost of manufacturing and/or constructing the thermal storage system. Assembling the graphite storage block 104 from a plurality of graphite blocks may facilitate the integration of thermal heating elements within the graphite storage block.

Assembling the graphite storage block 104 from a plurality of graphite blocks that include some insulation between them (e.g., a gap) may reduce heat flows between the block segments perpendicular to the axis of the insulation, which may provide improved radiation of heat on the particular surface of the assembled thermal storage block 104. Using FIG. 1D is an example, a rotatable pentagon-shaped thermal storage block 154 may be made up of five prism-shaped blocks 156*a*-156*e* that are coupled to a central heating element (e.g., 160) within a vertical support structure 158. By including gaps between each of the prism-shaped blocks, heat from the central heating element will preferentially flow toward the outer face of each prism-shaped block, and be impeded from flowing between the blocks. This may result in improved thermal radiation performance as thermal energy will radiate from the prism-shaped block facing the thermal energy receiver 130, while heat energy in the other prism-shaped blocks is inhibited from flowing towards the radiating prism-shaped block.

While the figures show the graphite storage block 104 stationary within the thermal storage system (e.g., 100*a*), in some embodiments, the graphite thermal storage block may be configured to be moved for heating and/or exposing thermal energy to the thermal energy receiver 130. For example, the graphite block may be positioned in a portion of the thermal storage chamber 102 removed from the window 108 for thermal charging and storage, and then moved so that a surface of the thermal block is positioned in front of the window 108 so that thermal energy can pass through the window and provide energy to the thermal energy receiver 130. In such embodiments, the graphite storage block may be supported on rollers (e.g., graphite rollers) and motivated by a driveshaft coupled to an external actuator mechanism (e.g., electric motor, pneumatic drive, etc.). In such embodiments, the thermal storage system chamber 102 may include a heating zone in which the heating elements, such as in the form of heat exchanger tubes (e.g., for a molten salt heating system) or electrical resistance heaters, are positioned in or along the walls and configured to add thermal energy to the graphite thermal storage block via radiative heating or conduction heating.

FIG. 2A shows further details about an embodiment of the thermal shutter 106 including two plates 116, 118. In this embodiment, a first graphite plate 116 may include a large number of through-passages or holes 202 that are sized and in sufficient numbers to permit a predetermined amount of thermal radiation to pass through the plate. Similarly, the second graphite plate 118 includes the same number of through-passages or holes 204 positioned in a matching pattern to the through-passages or holes 202 in the first graphite plate 116. In particular, the through-passages or holes 202, 204 may be sized and positioned on the respective plates such that the interstitial space 208 between the through-passages or holes 202, 204 along an axis of movement of the second graphite plate 118 is at least as large as the opening in the through-passages or holes. This size and positioning of the through-passages or holes 202, 204 enables the second graphite plate 118 to completely block thermal radiation by the interstitial space 208 when the second graphite plate 118 is moved vertically or horizontally by a controllable displacement 206. When the second graphite plate 118 is moved vertically or horizontally such that the through-passages or holes 204 align with the through-passages or holes 202 in the first graphite plate 116, thermal radiation from the graphite thermal storage block 104 can pass through the thermal shutter 106. By adjusting the position of the second graphite plate 118 within the controllable displacement 206 to partially align the through-passages or holes 202, 204, the thermal shutter 106 can throttle or control the amount of thermal radiation that passes through to the thermal energy receiver 130. In embodiments including more than two plates, such as three or four plates, the plates may include different shapes with two or more plates configured to be moved in tandem or independently to align or partially align through-passages or holes in the three or more plates to control the amount of thermal radiation reaching the thermal energy receiver 130.

In some embodiments, the thermal shutter 106 may include more than two plates, such as three or four plates, with two or more plates configured so that when actuated, the amount of thermal radiation reaching the thermal energy receiver 130 can be further controlled. For example, in a three-plate thermal shutter two plates could be actuated so as to expose the thermal energy receiver 130 to as much as 66% of the radiant energy from the graphite thermal storage block 104, while a four-plate thermal energy receiver three plates could be actuated so as to expose the thermal energy receiver 130 to as much as 75% of the radiant from the graphite thermal storage block 104. As a specific example, FIG. 2B illustrates an embodiment of a four-plate thermal shutter 106 including one fixed plate 116 and three moveable plates 118*a*-118*c*. A three-plate thermal shutter would be similarly configured including a fixed plate 116 and two moveable plates 118*a* and 118*b*.

In the non-limiting example illustrated in FIG. 2B, the through-passages or holes 202, 204 in the plates may have a larger opening dimension 210 (e.g., height) than the dimension 212 (e.g., height) of the interstitial space 208 between two through-passages or holes 202, 204 along the axis of movement, which is vertical in the illustrated example. The more moveable plates 118*a*-118*c* used in the thermal shutter 106, the larger the opening dimension 210 in the through-passages or holes 202, 204, and thus the greater the fraction of the window 108 area that can be exposed when the thermal shutter 106 is in the full open configuration. To close the shutter, the moveable plates 118*a*-118*c* need to be positioned so that the interstitial spaces 208 of all of the moveable plates stack up to cover each through-passages or holes 202 in the stationary plate 116. Thus, the dimension 212 of the interstitial space 208 in the plates may be the dimension 210 of the through-passages or holes 202, 204 divided by the number of moveable plates 118*a*-118*c*. For example, the dimension 212 of the interstitial space 208 between the through-passages or holes 202, 204 in the four-plate thermal shutter 106 illustrated in FIG. 2B may be approximately one-third of the dimension 210 of the through-passages or holes 202, 204. As another example, the dimension 212 of the interstitial space 208 between the through-passages or holes 202, 204 in a three-plate thermal shutter may be approximately one-half of the dimension 210 of the through-passages or holes 202, 204.

As the interstitial space 208 between the through-passages or holes 204 in the moveable plates 118*a*-118*c* provides the structure for closing the thermal shutter 106 (i.e., blocking the through-passages or holes 202 in the fixed plate 116), the theoretical maximum opening fraction of a thermal shutter based on moveable plates similar to the embodiments illustrated in FIGS. 2A and 2B is equal to one minus the inverse number of plates (e.g., Open Area°≈1−1/N where N is the number of plates). Thus, a three-plate thermal shutter (i.e., with one stationary plate 116 and two moveable plates 118*a*, 118*b*) may have a theoretical maximum opening fraction of about 66.6%, a four-plate thermal shutter (as illustrated) may have a theoretical maximum opening fraction of about 75%, and a five-plate thermal shutter may have a theoretical maximum opening fraction of about 80%.

While FIG. 2B shows the thermal shutter 106 oriented so that the moveable plates 118*a*-118*c* are articulated in the vertical dimension, in some embodiments the moveable plates 118*a*-118*c* may be configured to articulate along the horizontal dimension or along another axis.

Figure 2C:
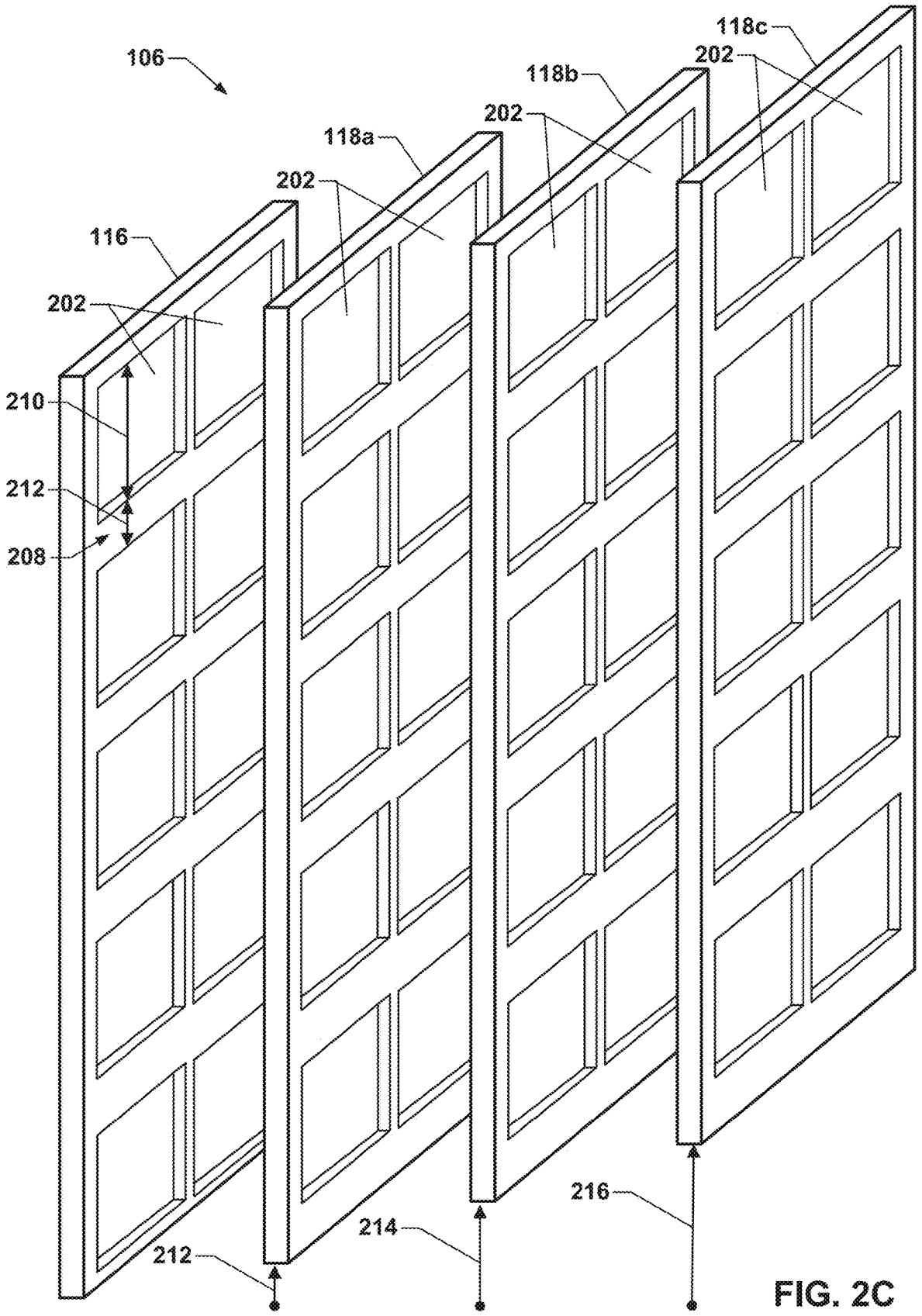
FIG. 2C is a perspective exploded view of the example configuration of a thermal shutter illustrated in FIG. 2B in a closed configuration according to some embodiments.

FIG. 2C illustrates the four-plate thermal shutter embodiment in a closed position. Specifically, FIG. 2C shows the moveable plates 118*a*-118*c* positioned so that the interstitial spaces 208 overlap with a third of the through-passages or holes 202 in the stationary plate 116. To fully cover the through-passages or holes 202 in the stationary plate 116, one of the moveable plates (118*a*) is articulated by the dimension 212 of the interstitial spaces 208, one of the moveable plates (118*b*) is articulated by a distance 214 equal to twice the dimension 212 of the interstitial spaces 208, and one of the moveable plates (118*c*) is articulated by a distance 216 equal to three times the dimension 212 of the interstitial spaces 208.

Figure 2D:
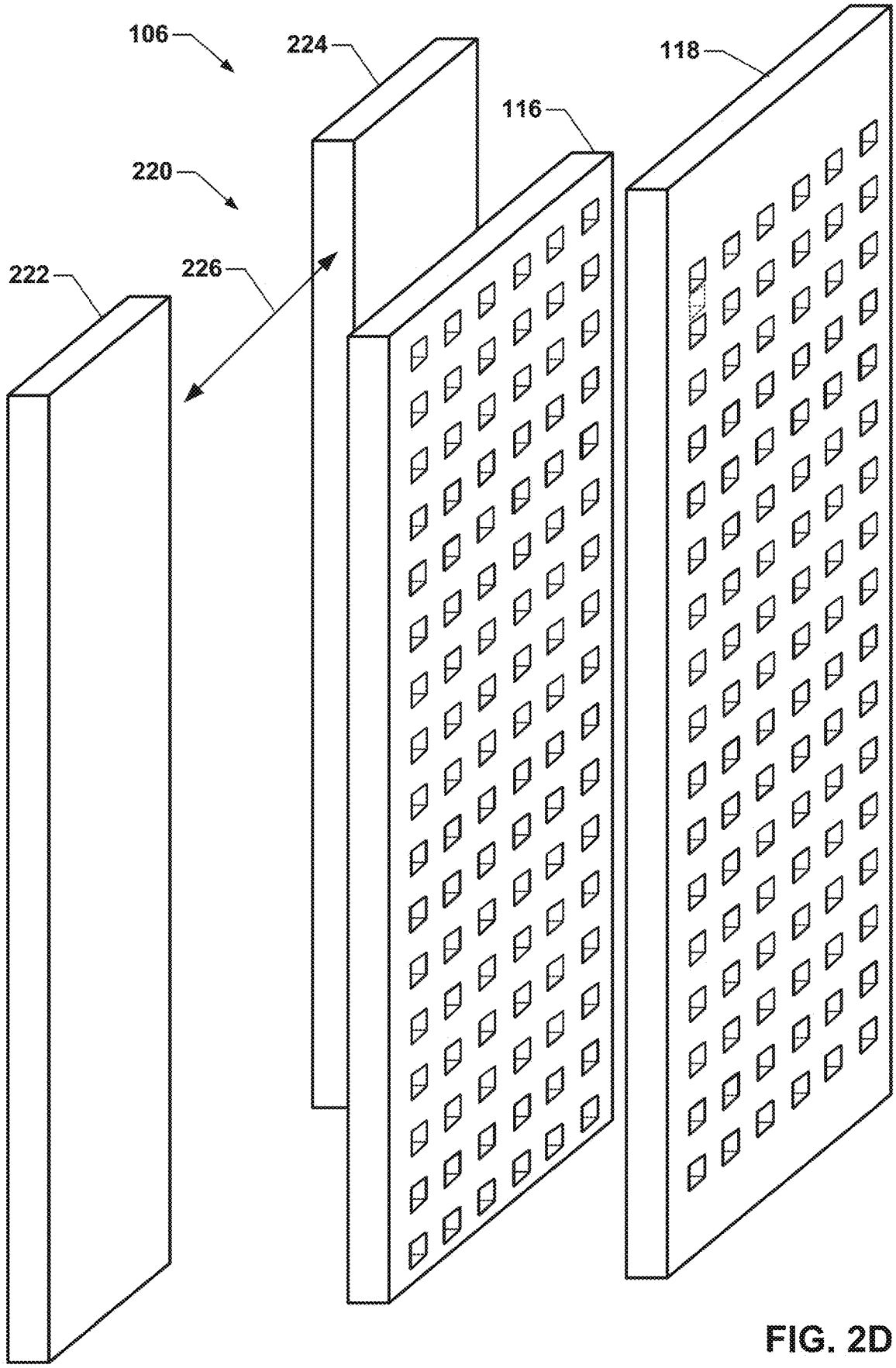
FIG. 2D is a perspective exploded view of an example configuration of a thermal shutter including two shutter elements and a closure mechanism according to some embodiments.

In some embodiments, the thermal shutter may be supplemented by a window closure mechanism 220 that may be actuated to fully block exposure of thermal radiation to the thermal energy receiver 130 regardless of the configuration of the thermal shutter 106. An example of this embodiment is illustrated in FIG. 2D, which shows a window closure mechanism 220 including two graphite plates 222, 224 that are coupled to actuators (not shown) and configured to be moved laterally (in the illustrated examples) together to block thermal energy, and apart through a distance 226 that may be approximately equal to the width of the window 108 and/or the thermal shutter 106. While FIG. 2D illustrates graphite plates 222, 224 configured to move horizontally, in some embodiments the plates 222, 224 may be coupled to actuators (not shown) and configured to move vertically. In a further embodiment, only a single graphite plate (e.g., one of 222 or 224) may be sized to cover the window 108 and coupled to an actuator (not shown) and configured move to fully cover or block the window or to fully uncover the window.

In some embodiments, a window closure mechanism 220 may be used in conjunction with the thermal shutter 106 to increase the range of control of thermal energy incident on the thermal energy receiver 130. For example, the size of the through-passages or holes 202, 204 compared to the interstitial spaces 208 in a two-panel thermal shutter 106 may be increased so that the thermal shutter has a maximum opening fraction greater than 50%, and the window closure mechanism 220 may be actuated to partially close the window 108 to reduce (e.g., throttle) the incident thermal energy below 50% of the area of the window.

In various embodiments, the thermal shutter 106 illustrated in FIGS. 2A-2D may be positioned on either side of the window 108, thus either inside the thermal insulation barrier 110*b* or outside the thermal insulation barrier 110*b*.

Figure 2E:
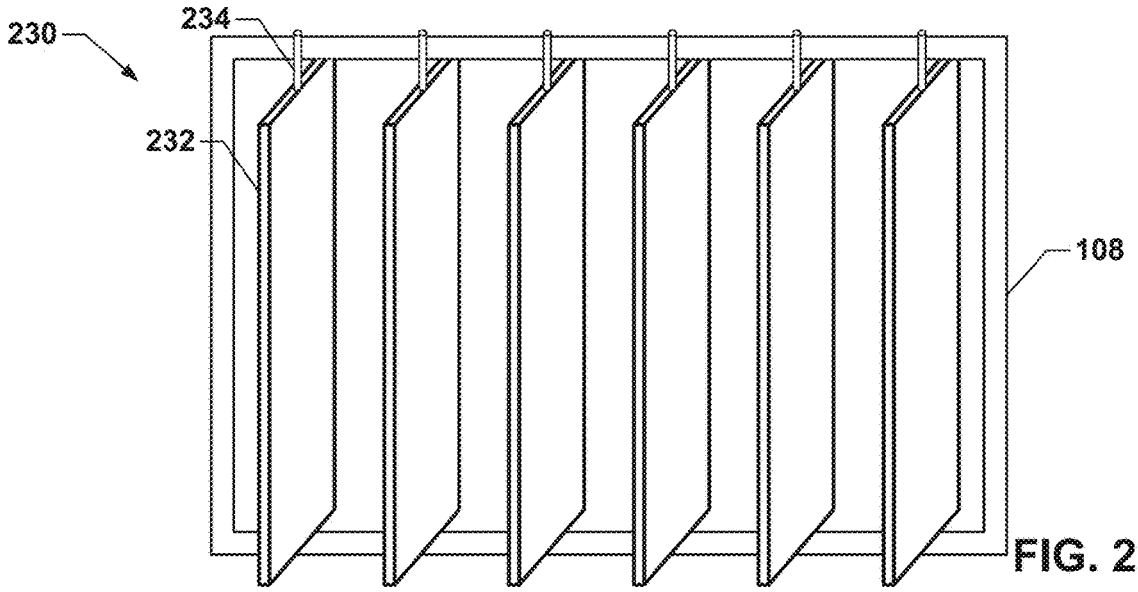
FIGS. 2E-2G are plan views of an example louver-type thermal shutter in partial open, full open and closed configurations, respectively, according to some embodiments.
Figure 2F:
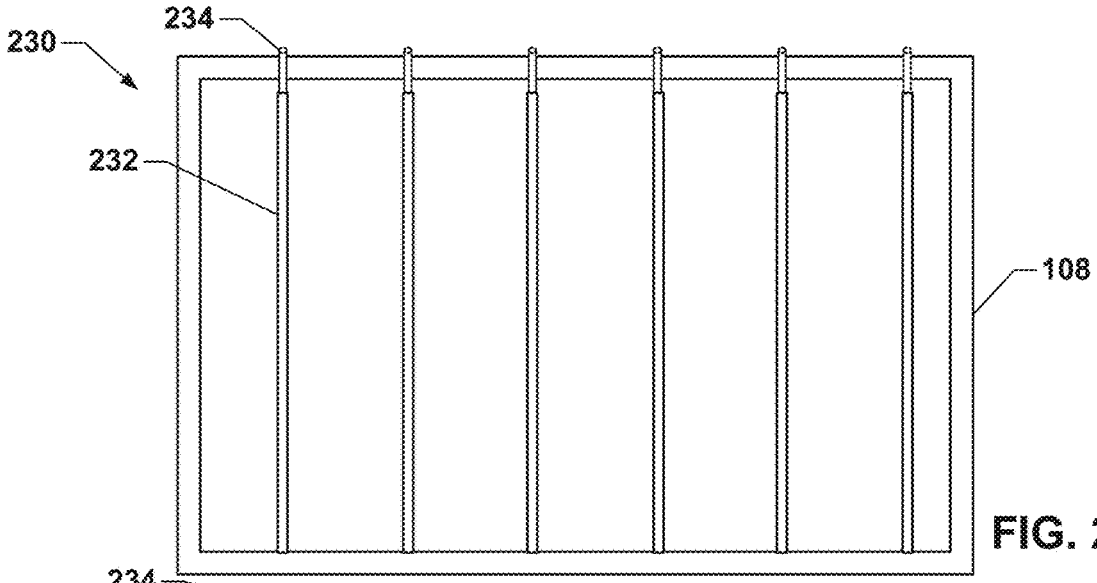
Figure 2G:
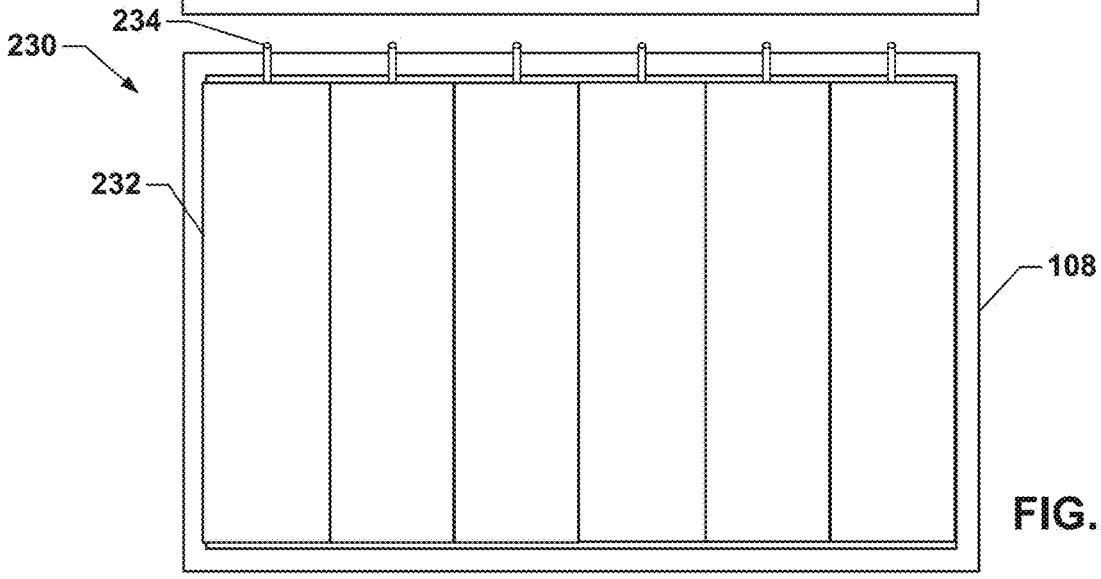
Figure 2H:
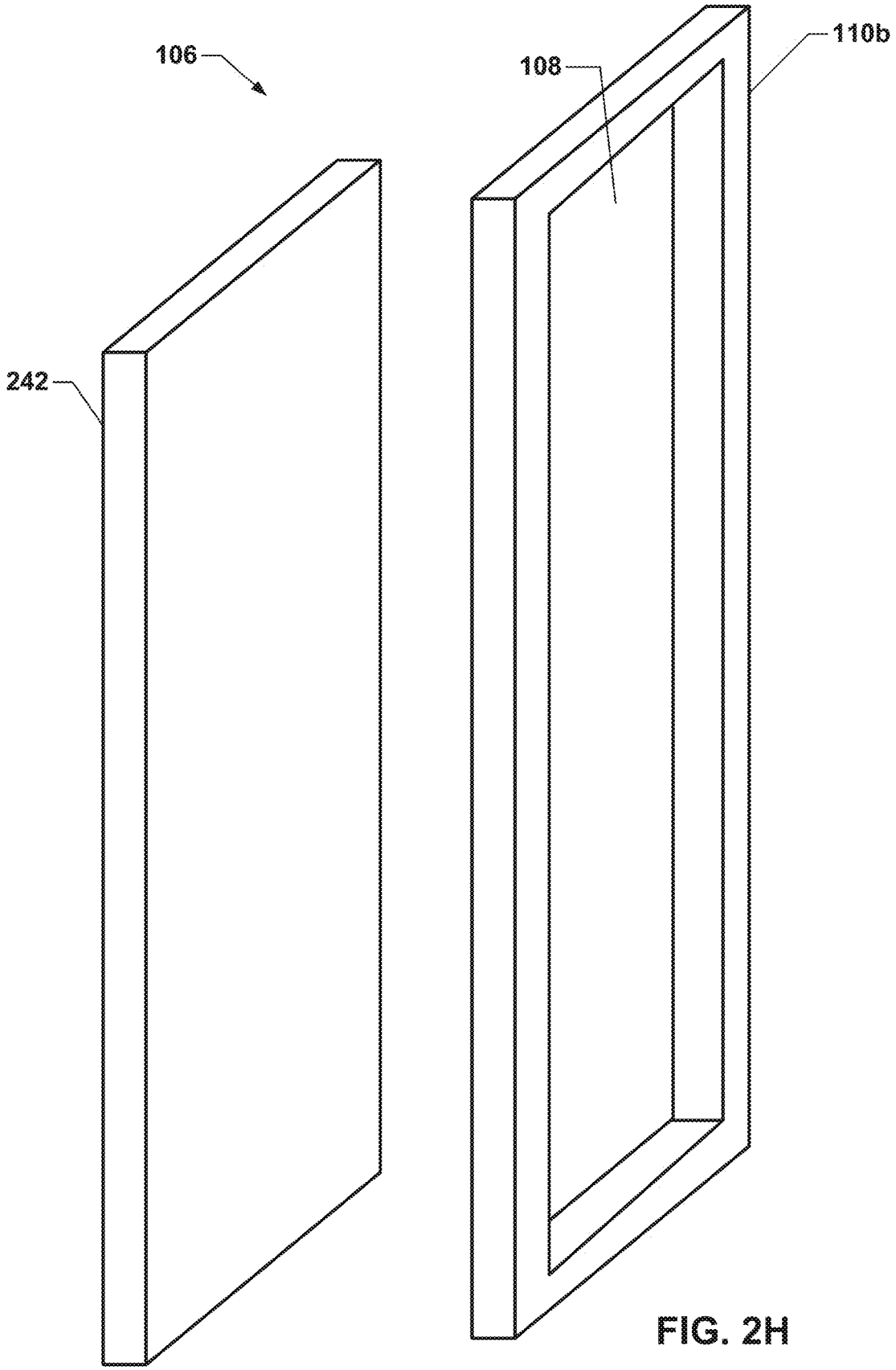
FIGS. 2H and 2I are plan views of example single plate thermal shutters according to some embodiments.

FIGS. 2E-2G illustrate another embodiment of a thermal shutter 230 in the form of a plurality of louver plates 232 coupled to rotation shafts 234 configured the rotate the plates through approximately 90 degrees (or more). As illustrated in FIG. 2E-2G, a plurality of louver panels 232 may be positioned across the span of the window 108, and configured to actuate rotationally to partially open (i.e., partially close) the thermal shutter 230 as illustrated in FIG. 2E, fully open the thermal shutter as illustrated in FIG. 2F, or fully close the thermal shutter as illustrated in FIG. 2G. The thermal shutter 230 may be positioned on either side of the window 108, thus either inside the thermal insulation barrier 110*b* or outside the thermal insulation barrier 110*b*.

Similar to other thermal shutter embodiments, the louver plates 232 may be made of low thermal conductivity graphite to withstand the high temperatures of the thermal storage system (e.g., 100*a*), and faced with low emissivity material (e.g., graphite foil) on the surface facing the graphite storage block 104 so as to minimize radiant heat transfer through the louver plates 232 when the thermal shutter 230 is in the closed position. The rotation shafts 234 may be coupled to one or more actuators (not shown but similar to actuators 120) positioned outside of the chamber 102. In some embodiments, all of the rotation shafts 234 may be coupled to a common actuator, such as through a common drive interface to the actuators, so the louver panels 232 rotate in the same amount simultaneously. In some embodiments, individual or a few of the rotation shafts 234 may be coupled to one of plurality of actuators so that the louver panels 232 may be rotated individually and independently, which may permit fine control of the amount of thermal energy that passes through the thermal shutter 230. Such actuators may be electrical motors (e.g., stepper motors) or hydraulic actuators coupled to a control system 150. As with other embodiments of the thermal shutter, the rotation shafts 234 and/or connected actuator(s) may be configured with a rapid closing "scram" actuation mechanism to provide rapid closing of the thermal shutter in the event of a power loss to the actuator(s) or a system anomaly.

In some embodiments, the louver panels 232 may be configured in different orientations as may be suitable for different window sizes or configurations of the thermal storage system. For example, louvers could be oriented in a radial fashion to form a radial shutter with a common central hub that provides an actuating mechanism. Such a radial veins may be supported at the central hub and at outer radial ring. To enable the actuator mechanism (e.g., within a common central hub) to operate in the high temperatures of the thermal storage system, an active cooling mechanism may be included as part of the actuator mechanism.

FIG. 2H illustrates another embodiment in which the thermal shutter 106 includes a single plate 242 with no through holes with the plate positioned adjacent to a window 108 in the thermal insulation barrier 110*b*. The single plate 242 may be made of a high-temperature, low thermal conductance material, such as graphite, configured to at least partially block transmission of thermal energy through the plate. The single plate 242 may be coupled to an actuator 120 (not shown), such as via a driveshaft 122 (not shown in FIG. 2H) coupled to an actuator mechanism 120 (not shown in FIG. 2H) that is positioned and configured to move the single plate 242 vertically or horizontally sufficient to uncover the window 108 to enable full thermal exposure to the thermal energy receiver 130 or crucible and to cover the window 108 to stop thermal exposure to the thermal energy receiver 130 or crucible. Further, the single plate 242 and actuator 120 may be configured to be move the plate with respect to the window 108 incrementally from the closed configuration to the open configuration (or vice versa) so as to incrementally uncover or cover the window 108, thereby enabling throttling or control of the amount of thermal energy exposed to the thermal energy receiver 130. The single plate 242 may be positioned on either side of the window 108, thus either inside the thermal insulation barrier 110*b* or outside the thermal insulation barrier 110*b*. A single plate thermal shutter 106 as illustrated in FIG. 2H may enable full exposure to the thermal energy receiver 130 or crucible of thermal energy from a thermal storage block 104 that passes through the window 108 in the thermal insulation barrier 110*b*.

Figure 2I:
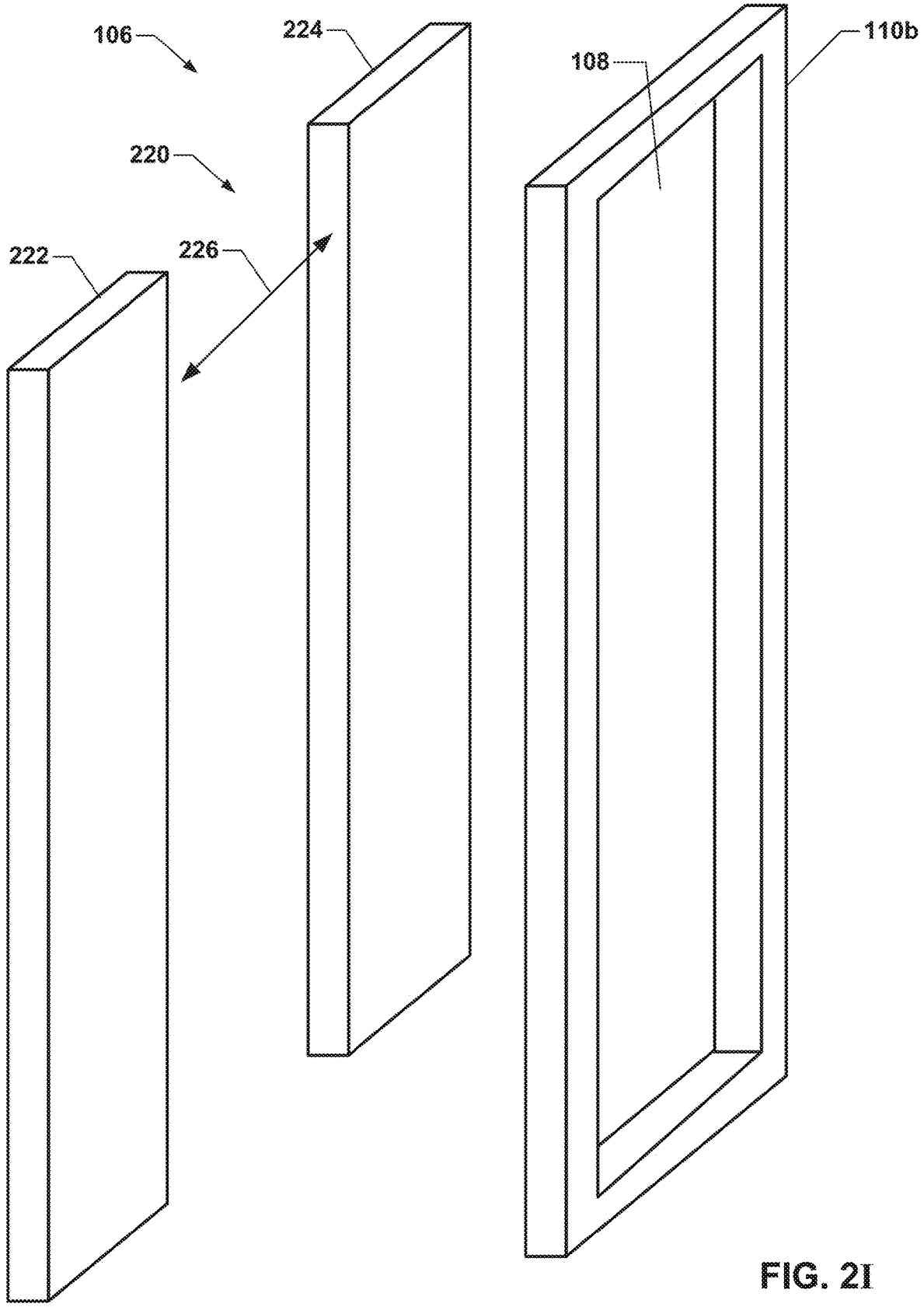

FIG. 2I illustrates another embodiment in which the thermal shutter 106 includes a window closure mechanism 220 including two graphite plates 222, 224 that are coupled to actuators 120 (not shown) and configured to be moved together laterally (in the illustrated example) to block thermal energy when in a fully closed configuration, and apart through a distance 226 that may be approximately equal to the width of the window 108 in the thermal insulation barrier 110*b*. By moving the two graphite plates 222, 224 apart or together incrementally, the window 108 may be incrementally uncovered or covered, thereby enabling throttling or control of the amount of thermal energy exposed to the thermal energy receiver 130. The embodiment illustrated in FIG. 2I does not include further plates (e.g., 116, 118) between the closure mechanism 220 and the window 108. The window closure mechanism 220 may be positioned on either side of the window 108, thus either inside the thermal insulation barrier 110*b* or outside the thermal insulation barrier 110*b*.

While FIG. 2I shows two plates 222, 224 that can open by moving apart laterally, other forms of a window closure mechanism 220 may be used in some embodiments, including two plates that overlap when closed and more than two moveable closure plates that overlap when closed. Using a window closure mechanism 220 with no other plates between the closure mechanisms and the window 108 as illustrated in FIG. 2I may enable full exposure to the thermal energy receiver 130 or crucible of thermal energy from a thermal storage block 104 that passes through the window 108 in the thermal insulation barrier 110*b*.

Figure 3A:
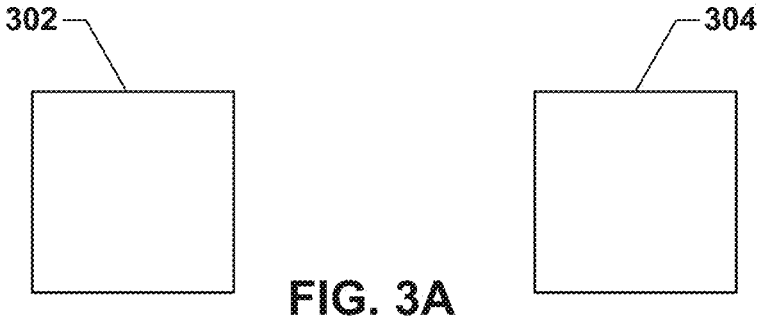
FIGS. 3A-3D illustrate examples of different shaped thermal transmission openings that may be implemented in thermal shutters according to some embodiments.

The through-passages or holes 202, 204 in some embodiments of the thermal shutter 106 may be of various shapes and sizes, such as illustrated in FIGS. 3A to 3D. For example, as shown in FIG. 3A, the first graphite plate 116 may include through-passages or holes 302 having a square or rectangular shape. Similarly, the second graphite plate 118 may include square or rectangular shaped through-passages or holes 304 of approximately the same size as those in the first graphite plate 116.

Figure 3B:
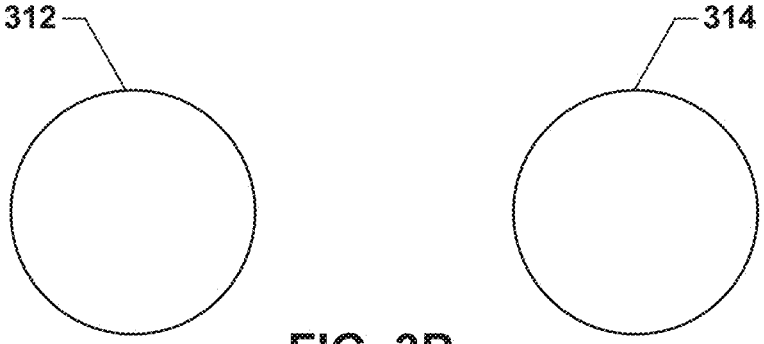

As another example illustrated in FIG. 3B, the first graphite plate 116 may include through-passages or holes 312 having a circular or elliptical shape. Similarly, the second graphite plate 118 may include circular or elliptical shaped through-passages or holes 314 of approximately the same diameter as those in the first graphite plate 116.

Figure 3C:
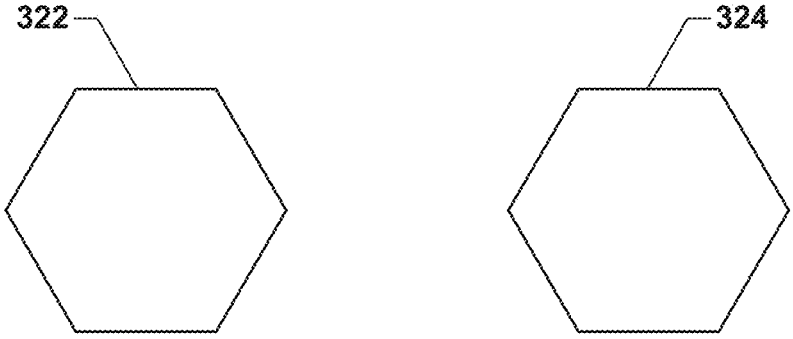

As another example illustrated in FIG. 3C, the first graphite plate 116 may include through-passages or holes 322 having other geometric shapes such as hexagonal. Similarly, the second graphite plate 118 may include similar shaped through-passages or holes 324 of approximately the same area as those in the first graphite plate 116.

Figure 3D:
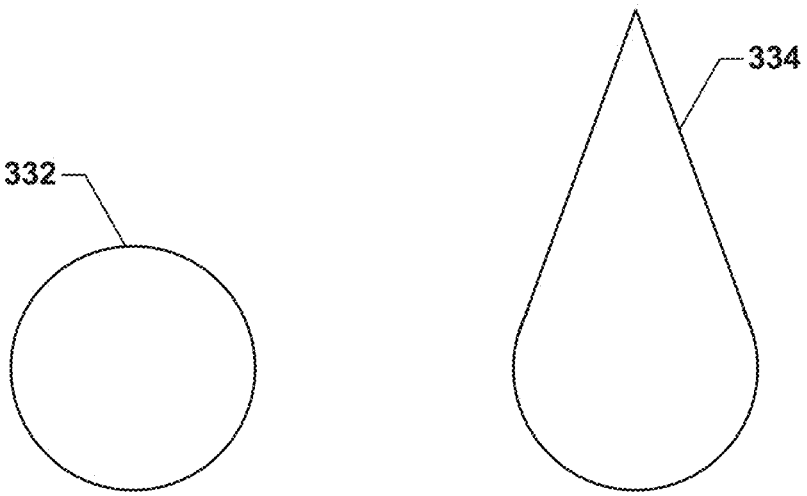

In some embodiments, the shapes and sizes of the through-passages or holes in the first and second graphite plates may differ. For example, as illustrated in FIG. 3D, the first graphite plate 116 may include through-passages or holes 332 having a circular or elliptical shape, the second graphite plate 118 includes through-passages or holes 334 with a shape that supports throttling of thermal radiation passing through the thermal shutter 106. In the example shown in FIG. 3D, the through-passage or hole 334 has a main section that is circular size to match the circular through-passage or hole 332 in the first graphite plate 116 when the two graphite plates are aligned, and a triangular shape adjacent to the main section that will permit increasingly reduced amount of thermal radiation to pass through the thermal shutter 106 as the second graphite plate 118 is increasingly misaligned with the first graphite plate 116.

Figure 4A:
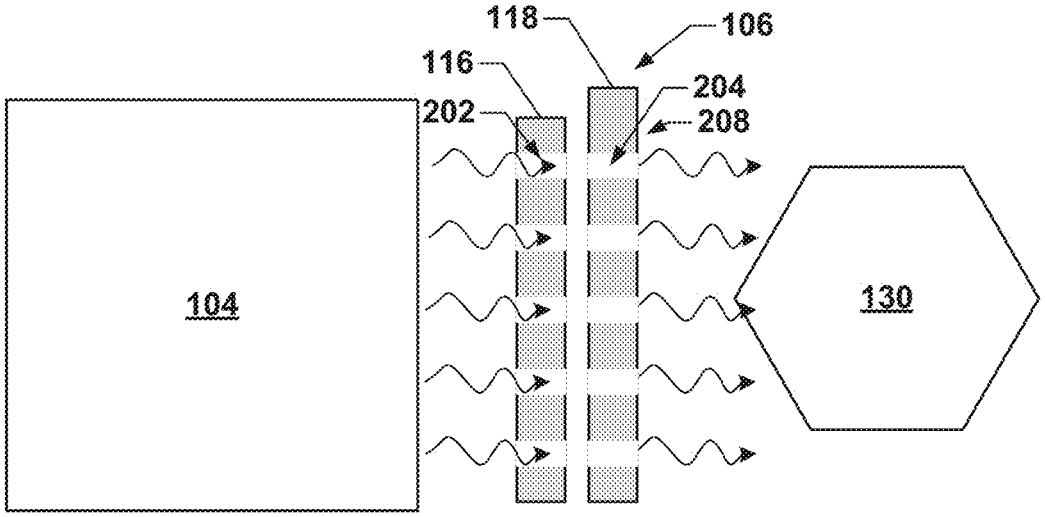
FIGS. 4A and 4B are block diagrams illustrating open and closed configurations of a thermal shutter between a thermal storage block and a thermal energy receiver (e.g., a heat exchanger or crucible) according to some embodiments.
Figure 4B:
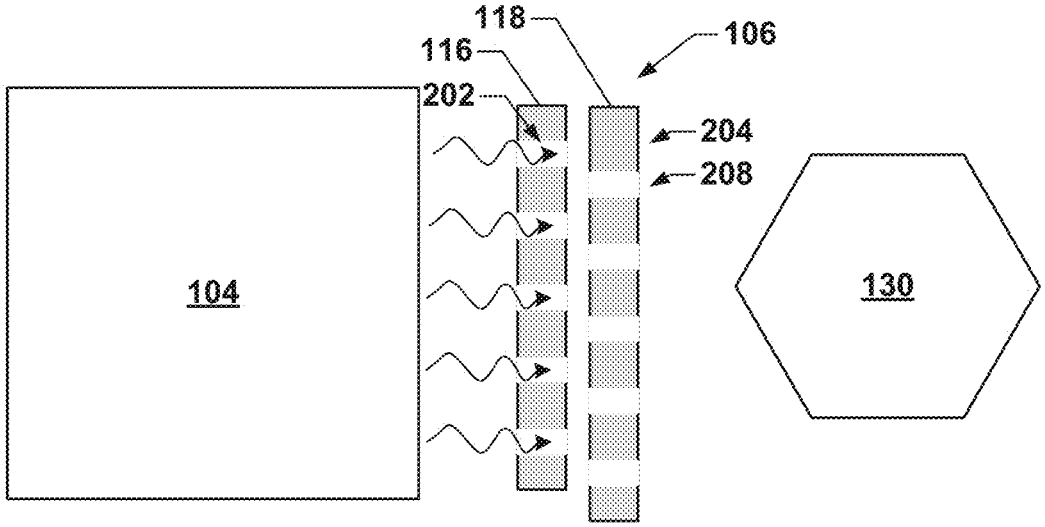

Operation of the thermal shutter 106 through movement of the second graphite plate 118 is further illustrated in FIGS. 4A and 4B. Referring to FIG. 4A, when the second graphite plate 118 is moved vertically or horizontally so that its through-passages or holes 204 align with the through-passages or holes 202 in the first graphite plate 116, thermal radiation (infrared and visible light) can pass through the thermal shutter 106 from the graphite thermal storage block 104 to deposit thermal energy on the thermal energy receiver 130 (e.g., a heat exchanger, steam generator, thermionic power converter, crucible for processing objects or materials, etc.). Referring to FIG. 4B, when the second graphite plate 118 is moved vertically or horizontally so that its through-passages or holes 204 do not align with the through-passages or holes 202 in the first graphite plate 116, thermal radiation from the graphite thermal storage block 104 is blocked by the thermal shutter 106. Further, a low emissivity material, e.g. graphite foil, may be added to the graphite plates 116 and 118 on the surface facing graphite thermal storage block 104 to reflect thermal radiation back to the graphite thermal storage block 104 when the shutters are closed.

Figure 5:
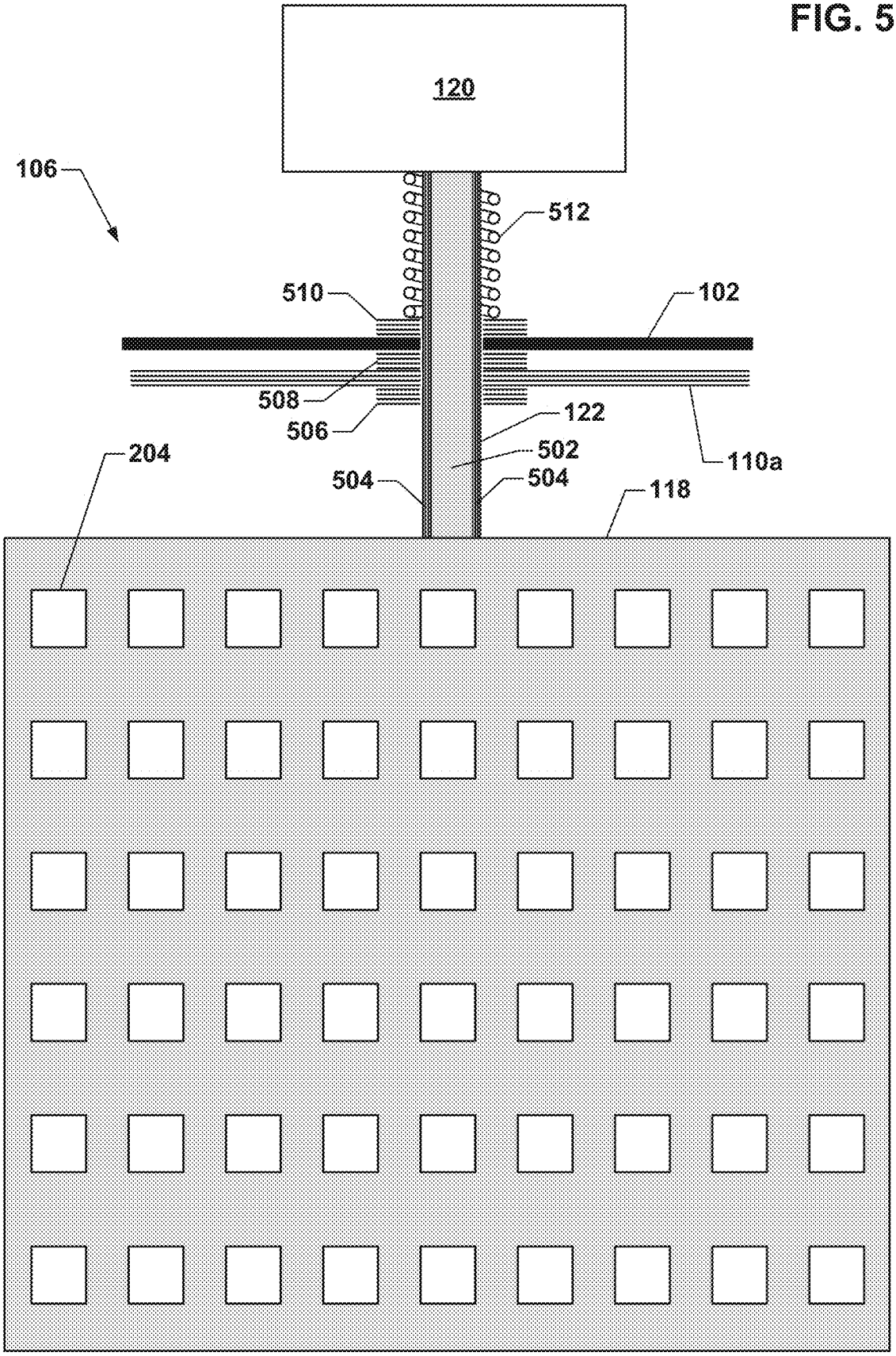
FIG. 5 is a block diagram showing a side view of a detail of a thermal shutter, a thermal shutter actuator and a connector therebetween according to some embodiments.

FIG. 5 is a cross-sectional view of the second graphite plate 118 of a thermal shutter 106 showing some details of the assembly. In particular, FIG. 5 illustrates how the driveshaft 122, which physically connects the second graphite plate 118 to the actuator 120, passes through the thermal insulation 110*a* and the chamber 102 walls. Due to the high temperatures that are expected to exist inside the chamber 102 of a thermal storage system (e.g., 100*a*), a load bearing element 502 of the driveshaft 122 may be made of a high-temperature material, such as graphite. In order to reduce thermal stresses on the load bearing element 502, the driveshaft 122 may include insulation 504 on an exterior surface. As with other insulation structures, the insulation 504 on an exterior surface may be one or more layers of low thermal conductivity and low emissivity materials, such as graphite foil. In addition to reducing thermal stresses on the load bearing element 502, such insulation 504 would reduce the amount of thermal energy leaking out of the chamber 102 through the driveshaft 122.

As illustrated in FIG. 5, additional insulation materials 506, 508, 510 may be included surrounding the opening in the chamber 102 and its thermal insulation 110*a* through which the driveshaft 122 passes so as to minimize thermal leakage. As with other insulation structures, the additional insulation materials 506, 508, 510 may be low thermal conductivity and low emissivity materials, such as multiple sheets of graphite foil. Minimizing thermal leakage will be important for maintaining the efficiency of the thermal storage system (e.g., 100*a*), but also may be necessary to minimize thermal stress on system components outside of the chamber 102, such as the actuators 120 controlling the thermal shutters 106. For example, additional insulation may be added around the penetration in the thermal insulation 110*a* through which the driveshaft 122 passes on the interior side (506) and/or between the thermal insulation layer 110*a* and the wall of the chamber 102 (508). Also, additional insulation 510 may be applied to the exterior of the chamber 102 surrounding the penetration in the chamber wall through which the driveshaft 122 passes. In some embodiments, thermal insulation on an exterior surface may include passages for flowing cooling fluid through the insulation to provide further thermal protection for the drive shaft and equipment on the exterior of the chamber 102.

In some embodiments, the actuator 120, and/or the driveshaft 122 may include a mechanism for rapidly closing the thermal shutter 106, referred to herein as a "scram" mechanism, such as to protect the thermal energy receiver 130 from overheating or protect the graphite thermal storage block 104 from fluids or gasses released by the thermal energy receiver 130 (e.g., from a rupture in a fluid heat exchanger element). As a non-limiting example, FIG. 5 shows a spring 512 that is configured to push the driveshaft 122 and second graphite plate 118 down to a closed position. In this example embodiment, the spring 512 may be configured to rapidly drive the second graphite plate 118 to the closed position in response to a loss of power to the actuator 120 or to release of the driveshaft 122 by an action of the actuator 120. Such a "scram" mechanism may enable the thermal shutter to be closed much faster than possible through normal operation of the actuator 120, which may be useful as a safety or system protective mechanism under a variety of operational or fault conditions. Any of a variety of passive and rapid closing mechanisms (e.g., hydraulic actuators, gravity-assisted mechanisms, and springs of different configurations), and any of a variety of configurations (e.g., horizontal actuation, bottom-up vertical actuation, etc.) may be used to provide the "scram" capability in various embodiments.

Figure 6A:
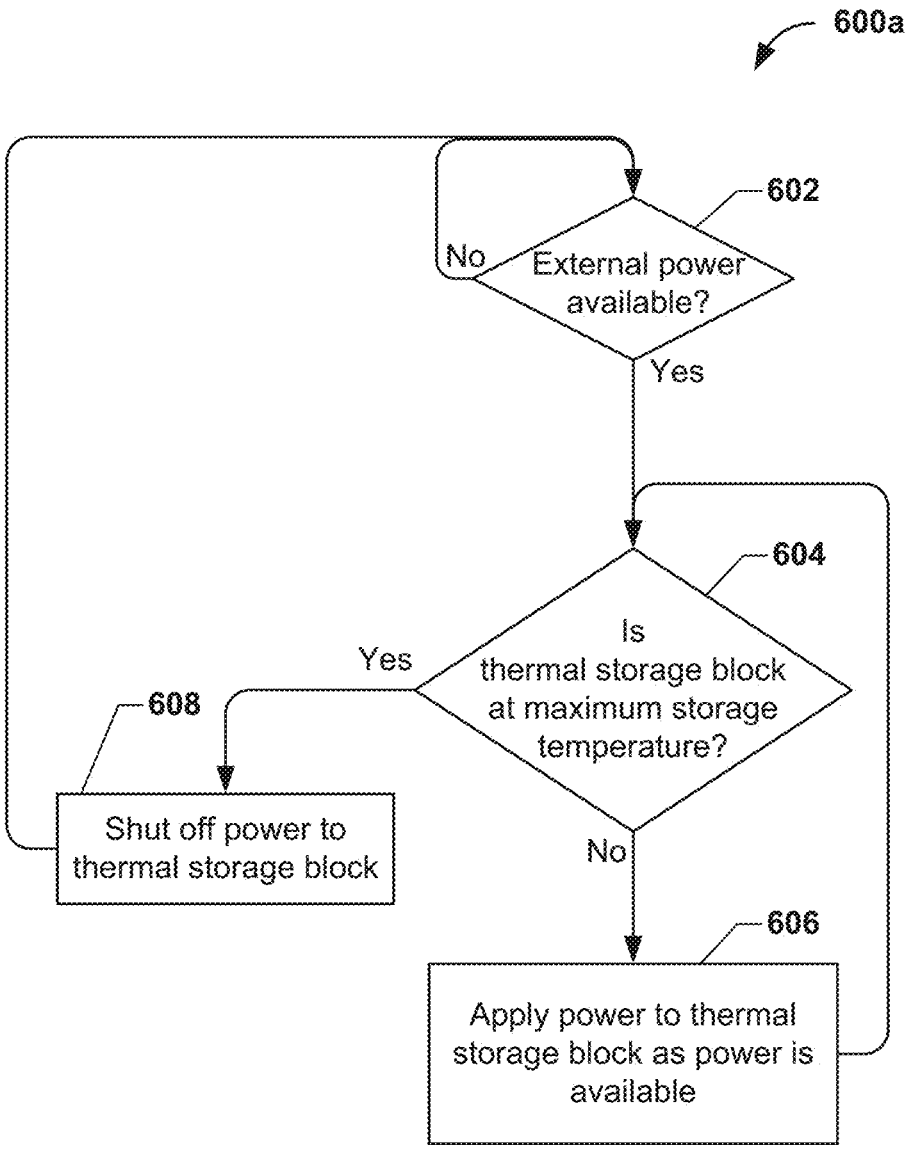
FIG. 6A is a process flow diagram illustrating an example method for storing energy in a thermal storage system according to various embodiments.

FIG. 6A is a process flow diagram illustrating an example of a method 600*a* that may be performed by a control system for operating a thermal storage system, particularly storing energy in the graphite thermal storage block, according to some embodiments. Means for performing functions of the method 600*a* include a computing device 150 configured to receive inputs from an external power source and executing control system processes.

The method 600*a* includes operations to store energy in the form of heat within the thermal storage system whenever external power is available. Thus, in determination block 602, the control system may determine from inputs received from external power sources whether external power is available. Using the example of a solar array power source, the control system may receive an input from the solar power system indicating whether sufficient power is available from the solar arrays to begin applying power to the thermal energy storage system. Using the example of solar concentrator that uses mirrors to focus sunlight onto a molten salt heat exchanger, computing device may receive an input from the solar concentrator system indicating that thermal energy is available for storage form of molten salt. Using the example of a windfarm power source, the control system may receive an input from the windfarm indicating whether sufficient power is being generated by wind turbines to begin applying power to the thermal energy storage system. Using the example of a power grid, the control system may receive an input from the utility indicating whether excess power (i.e., power generated beyond the amount of power demanded by utility customers) is available that could be used to input heat into the thermal energy storage system. So long as external power is not available (i.e., determination block 602="No"), the control system may continue to monitor for indications that external power is available in determination block 602.

The process of determining whether external power is available and applying external power to the graphite thermal storage block as such power is available may be performed periodically or continuously, thus enabling the storage of thermal energy whenever external power is available (e.g., during transient periods of excess power on the utility grid, during gust of wind through a windfarm, etc.) and storing the applied power as thermal energy by disconnecting the thermal storage system from the external power source whenever power is not available or when the graphite thermal storage block is at or near the maximum operating temperature.

In response to determining that external power is available for charging the thermal storage system (i.e., determination block 602="Yes"), the control system may monitor temperature sensors (e.g., thermoresistors or thermocouples) coupled to or within the graphite thermal storage block to determine whether the graphite thermal storage block is at the maximum storage temperature in determination block 604. For example, the control system may monitor temperature sensors to determine whether the graphite thermal storage block is at or approaching a maximum operating temperature of about 4000 degrees Fahrenheit (4000° F.). In some embodiments, the maximum operating temperature of the graphite thermal storage block may be adjusted, such as to limit a maximum thermal energy flux exposed to the thermal energy receiver (e.g., heat exchanger or crucible).

In response to determining the temperature of the graphite thermal storage block is below maximum storage temperature (i.e., determination block 604="No"), the control system may issue commands to various relays or circuitry (not shown) to apply the external power to the graphite thermal storage block while power is available in block 606. For example, the control system may send command signals to activate one or more relays coupling the heating elements 114 to the external power source, thereby enabling the heating elements to inject thermal energy into the graphite thermal storage block 104. While power is applied to the graphite thermal storage block in block 606, the control system may continue to monitor the temperature of the graphite thermal storage block in determination block 604.

In response to determining the temperature of the graphite thermal storage block is at or near the maximum storage temperature (i.e., determination block 604="Yes"), the control system may issue commands to various relays or circuitry (not shown) to shutoff power to the graphite thermal storage block in block 608. This may prevent the storage temperature from exceeding the maximum temperature.

After shutting off power to the graphite thermal storage block in block 608, the control system may again check whether power is available for reheating the graphite thermal storage block in determination block 602 as described, and the method 600*a* may be repeated.

Figure 6B:
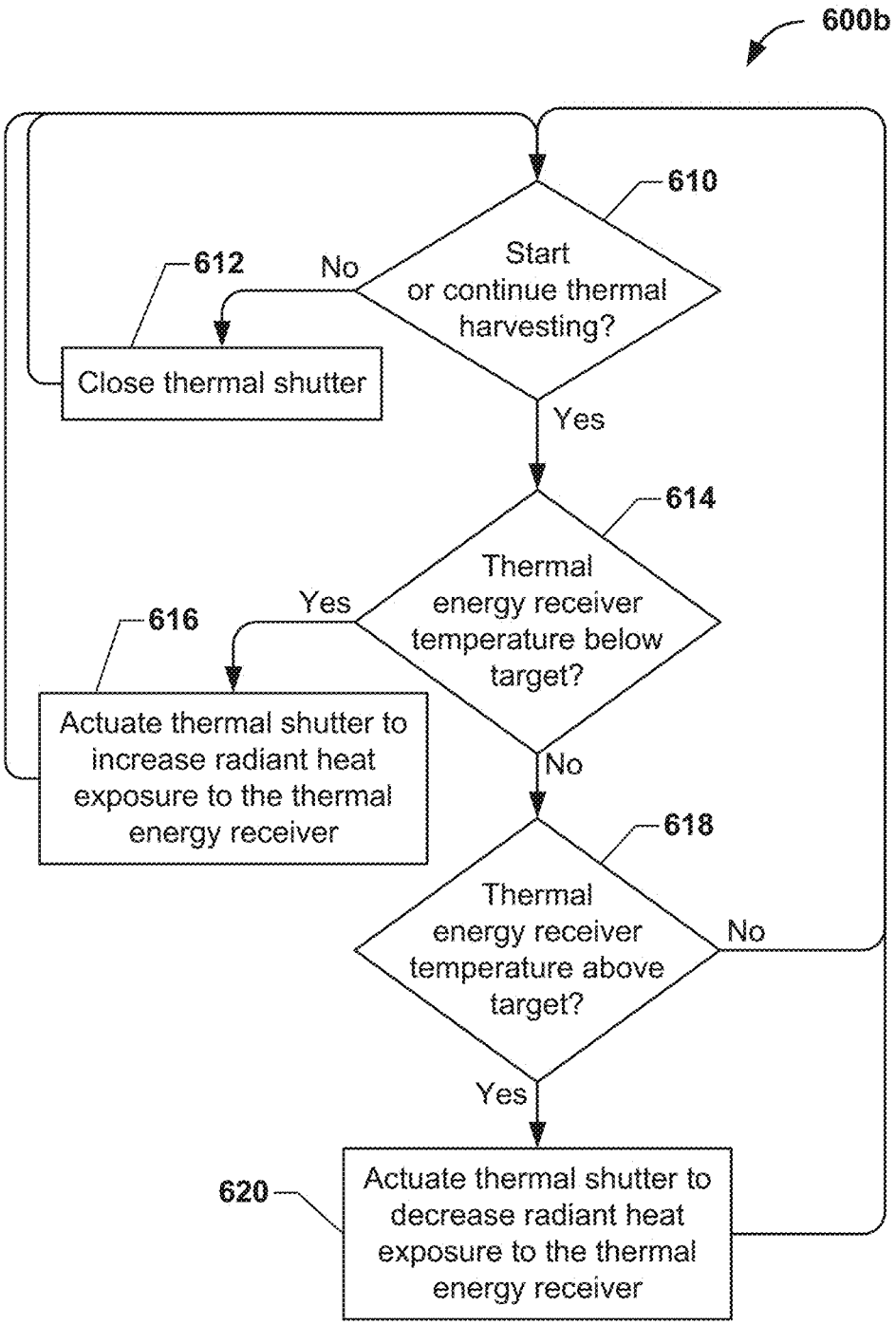
FIG. 6B is a process flow diagram illustrating an example method for controlling thermal shutters of a thermal storage system according to various embodiments.

FIG. 6B is a process flow diagram illustrating an example of a method 600*b* for applying stored energy from a thermal storage block to a thermal energy receiver according to some embodiments. The method 600*b* illustrates an example of a method by which the thermal storage system may regulate the application of thermal energy to a thermal receiver in a controlled manner to achieve a desired outcome, such as applying heat to a thermionic power converter, heating a working fluid in a heat exchanger to generate steam, heated molten salt, or a hot gas, or applying thermal energy to a material (e.g., metal, glass, etc.) as part of a thermal treatment or smelting process. Means for performing functions of the method 600*b* include a computing device 150 configured to receive temperature data from various temperature sensors 140, 141, 142 within the system, and particularly sensors associated with the thermal energy receiver 130 (or crucible in applications for thermal processing of materials), and to send control instructions to the actuators 120 coupled to the thermal shutters 106.

In determination block 610 the control system may determine whether the system is being activated to start or continue thermal harvesting by exposing the thermal energy receiver to radiant energy. Some applications may not require use of thermal energy around-the-clock, such as an industrial steam application may only require steam during working hours or batch process periods. Other applications may require thermal energy in periodic short bursts, such as to thermally process material for a specific duration when the material is placed within a crucible.

In response to determining that thermal harvesting is not required or has ended (i.e., determination block 610="No"), the control system may send control signals to one or more actuators to close the thermal shutter(s) (or maintain that thermal shutter in a closed position) in block 612. Thus, when thermal shutters are closed in block 612 and external power is being applied to the graphite thermal storage block in block 606, the amount of energy stored as heat in the graphite thermal storage block of the thermal energy storage system will increase as the internal temperature of the block rises.

In response to determining that thermal harvesting should begin or continue (i.e., determination block 610="Yes"), the control system may receive temperature data from any of a variety of temperature sensors (e.g., one or more temperature sensors within or coupled to a thermal energy receiver), and determine from such temperature data whether the thermal energy receiver (e.g., a thermionic power converter, heat exchanger or crucible) temperature is below a target temperature in determination block 614. For example, a thermionic power converter may need to be maintained within a set temperature range to generate a target amount of power efficiently.

In response to determining that the thermal energy receiver (e.g., a thermionic power converter, heat exchanger or crucible) temperature is below the target temperature (i.e., determination block 614="Yes"), the control system may send control signals to actuate the thermal shutter(s) in block 616, thereby increasing radiant heat exposure from the graphite thermal storage block to the thermal energy receiver (e.g., a thermionic power converter, heat exchanger or crucible). As described above, in some embodiments this may involve moving the second graphite plate 118 so that the through-passages or holes 204 align or partially align with the corresponding through-passages or holes 202 in the first graphite plate 116. In embodiments in which the thermal shutter includes three or more plates, this may involve moving two or more plates in tandem or independently to align or partially align through-passages or holes in the three or more plates. The amount of movement performed in one process cycle through block 616 may be a fraction of the controllable displacement 206 so as to incrementally increase the amount of radiant heat that reaches the thermal energy receiver in one control cycle. The control system may then confirm whether thermal harvesting should continue in determination block 610, and if so, again determine whether the thermal energy receiver temperature is below the target temperature in determination block 614.

In response to determining that the thermal energy receiver temperature is not below the target temperature (i.e., determination block 614="No"), the control system may determine from the temperature data from the temperature sensors whether the thermal energy receiver temperature is above the target temperature in determination block 618.

In response to determining that the thermal energy receiver temperature is not above the target temperature (i.e., determination block 618="No"), the control system may take no action with respect to the position of the thermal shutter(s) and may again confirm whether thermal harvesting should continue in determination block 610, and if so, again determine whether the thermal energy receiver temperature is below the target temperature in determination block 614.

In response to determining that the thermal energy receiver temperature is above the target temperature (i.e., determination block 618="Yes"), the control system may send control signals to actuate the thermal shutter(s) in block 620 to decrease radiant heat exposure from the graphite thermal storage block to the thermal energy receiver. As described above, this may involve moving the second graphite plate 118 so that the alignment of through-passages or holes 204 align with the corresponding through-passages or holes 202 in the first graphite plate 116 is reduced, thereby reducing the radiant heat exposure to the thermal energy receiver. In embodiments in which the thermal shutter includes three or more plates, this may involve moving two or more plates in tandem or independently to misalign or partially misalign through-passages or holes in the three or more plates.

The amount of movement performed in one process cycle through block 620 may be a fraction of the controllable displacement so as to incrementally decrease the amount of radiant heat that reaches the thermal energy receiver in one control cycle. The control system may then confirm whether thermal harvesting should continue in determination block 610, and if so, again determine whether the thermal energy receiver temperature is below the target temperature in determination block 614.

While the method 600*b* illustrated in FIG. 6B shows three determination operations performed in a sequence, this illustration is merely one example of a suitable control method. In various embodiments the determinations in blocks 610, 614 and 618 may be performed in a different order or in two or a single determination operation. Further, other control methods may be implemented to control the actuation of thermal shutters in order to control the transmission of energy stored as heat in the graphite thermal storage block.

While the method 600*b* illustrated in FIG. 6B involves actuating the thermal shutter (i.e., moving the second plate 118 relative to the first plate 116) to maintain the temperature(s) of the thermal energy receiver within a range between the minimum and maximum target temperatures, other control methods may be implemented in some embodiments. For example, in some embodiments, the control system may control the actuator(s) to actuate the thermal shutter so as to control or throttle the amount of thermal radiant energy per unit time, such as watts/hr. or BTU/hr. reaching the thermal energy receiver. Such energy exposure rates may be controlled on a unit bases, such as BTU/hr./cm$^2$, or for the entire thermal energy receiver, such as total watts/hr. or BTU/hr.

This may be accomplished by the control system monitoring temperatures of the thermal energy receiver with knowledge of the specific heat capacity of the thermal energy receiver, or by monitoring sensors that measure thermal heating rate or thermal power. Further, in some embodiments, control methods may apply or consider measurable parameters, factors or conditions other than just temperature, such as overall total-system efficiency, weather conditions or patterns (e.g., for solar- or wind-powered systems), economic factors, contractual requirements, etc. Also, in some embodiments, control methods may control system elements other than thermal shutters and power applied to the graphite thermal storage block, such as the flow rate of working fluid passing through a heat exchanger thermal energy receiver, movement or positioning of the graphite thermal storage block, the thermal energy receiver and/or materials or products within the thermal energy receiver. For example, as described in more detail with reference to FIG. 6D for the use case of a water-to-steam heat exchanger application, the control method may also adjust the flow rate of water into the heat exchanger as a function of the graphite thermal storage block temperature to maintain a target output steam temperature or enthalpy.

Figure 6C:
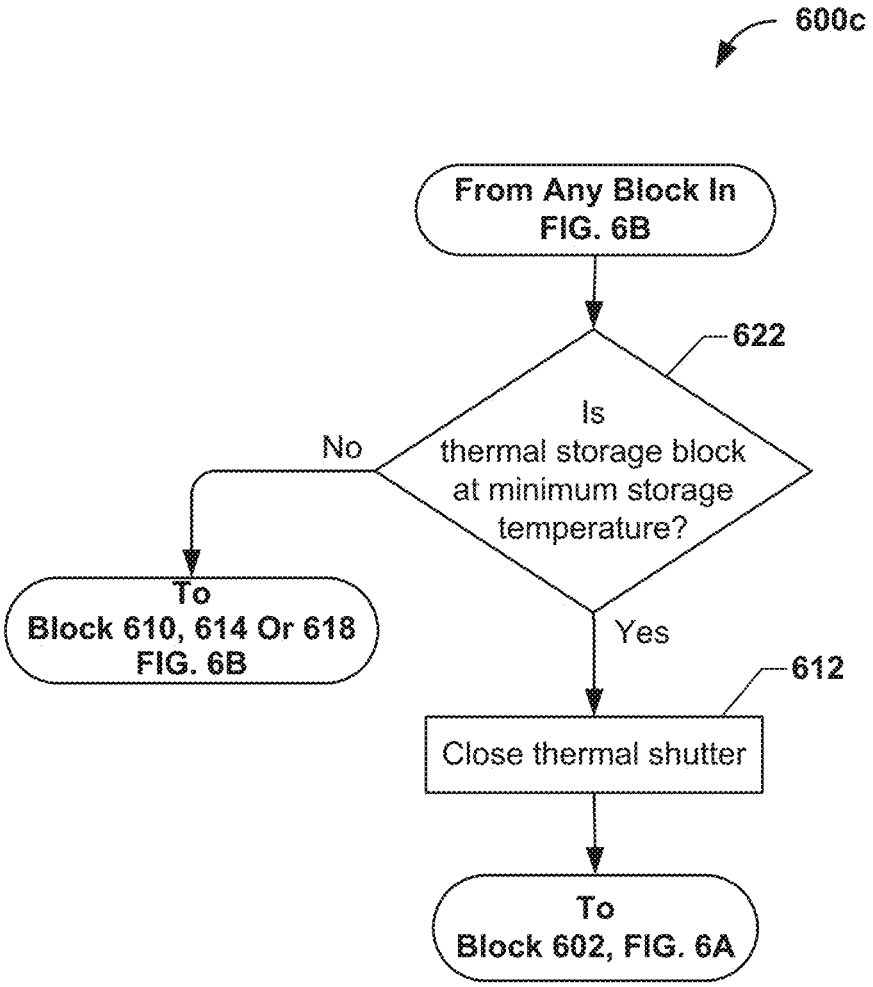
FIG. 6C is a process flow diagram illustrating an example of additional operations that may be included in method for controlling a thermal storage system according to various embodiments.

FIG. 6C is a process flow diagram illustrating of operations that may be implemented as part of the method 600*b* for controlling the temperature of the graphite thermal storage block above a minimum according to some embodiments. To avoid reducing the temperature of the graphite thermal storage block below a minimum threshold temperature suitable for irradiating the thermal energy receiver and/or avoiding thermal cycling stress to the graphite thermal storage block, the thermal storage system may monitor temperature(s) of the graphite thermal storage block and take action to terminate harvesting of thermal energy when the graphite thermal storage block temperature falls below the minimum threshold temperature. Means for performing functions of the operations 600*c* include a computing device 150 configured to receive temperature data from various temperature sensors 140, 142 within the system, and particularly temperature sensors 141 associated with the graphite thermal storage block 104.

The operations 600*c* may be implemented following or as part of the operations in any of the blocks of the method 600*b* illustrated in FIG. 6B. For example, the operations 600*c* may be implemented during or following the operations in block 616 when the thermal shutters are actuated to increase the radiant heat exposure to the thermal energy receiver, and thus draw energy out of the graphite thermal storage block. As another example, the operations 600*c* may be implemented as part of or following any of the determinations made by the thermal storage system in determination blocks 610, 614, or 618.

Referring to FIG. 6C, in determination block 622, the thermal storage system may determine whether the graphite thermal storage block is at a minimum temperature. In some embodiments, the thermal storage system may monitor one or more temperature sensors (e.g., thermoresistors or thermocouples) and compare indicated temperatures to a temperature threshold stored in memory. For example, the control system may monitor temperature sensors to determine whether the graphite thermal storage block is above a minimum operating temperature of about 2000 degrees Fahrenheit (2000° F.). As another example, in a thermal storage system (e.g., 100*a*) including a steam-generating thermal energy receiver 130, the minimum operating temperature for the graphite thermal storage block may be about 1000 degrees Fahrenheit (1000° F.). In some embodiments, the minimum temperature threshold may be adjusted depending upon the type of thermal processing that is being performed in the thermal energy receiver, such as to ensure the radiant energy received by the thermal energy receiver is equal to or greater than a minimum necessary for accomplishing a particular purpose (e.g., generating steam at a particular temperature or treating material above a given temperature). In some embodiments, the minimum temperature threshold may be set at a minimum temperature below which the graphite thermal storage block could experience thermal cycle stresses that could shorten the life of the material.

In response to determining that the graphite thermal storage block is above the minimum storage temperature (i.e., determination block 622="No"), and thus the graphite thermal storage block is hot enough to continue irradiating the thermal energy receiver, the thermal storage system may perform the operations in the method 600*b* as described, such as performing the determination in one of determination blocks 610, 614 or 618.

In response to determining that the graphite thermal storage block is at or below the minimum storage temperature (i.e., determination block 622="Yes"), the thermal storage system may close the thermal shutter in block 612 in order to retain thermal energy in the graphite thermal storage block, and perform the operations in the method 600*a* to add thermal energy to the block. For example, after closing the thermal shutter in block 612, the thermal storage system may again determine whether external power is available for energizing the graphite thermal storage block in block 602 of the method 600*a* as described.

Figure 6D:
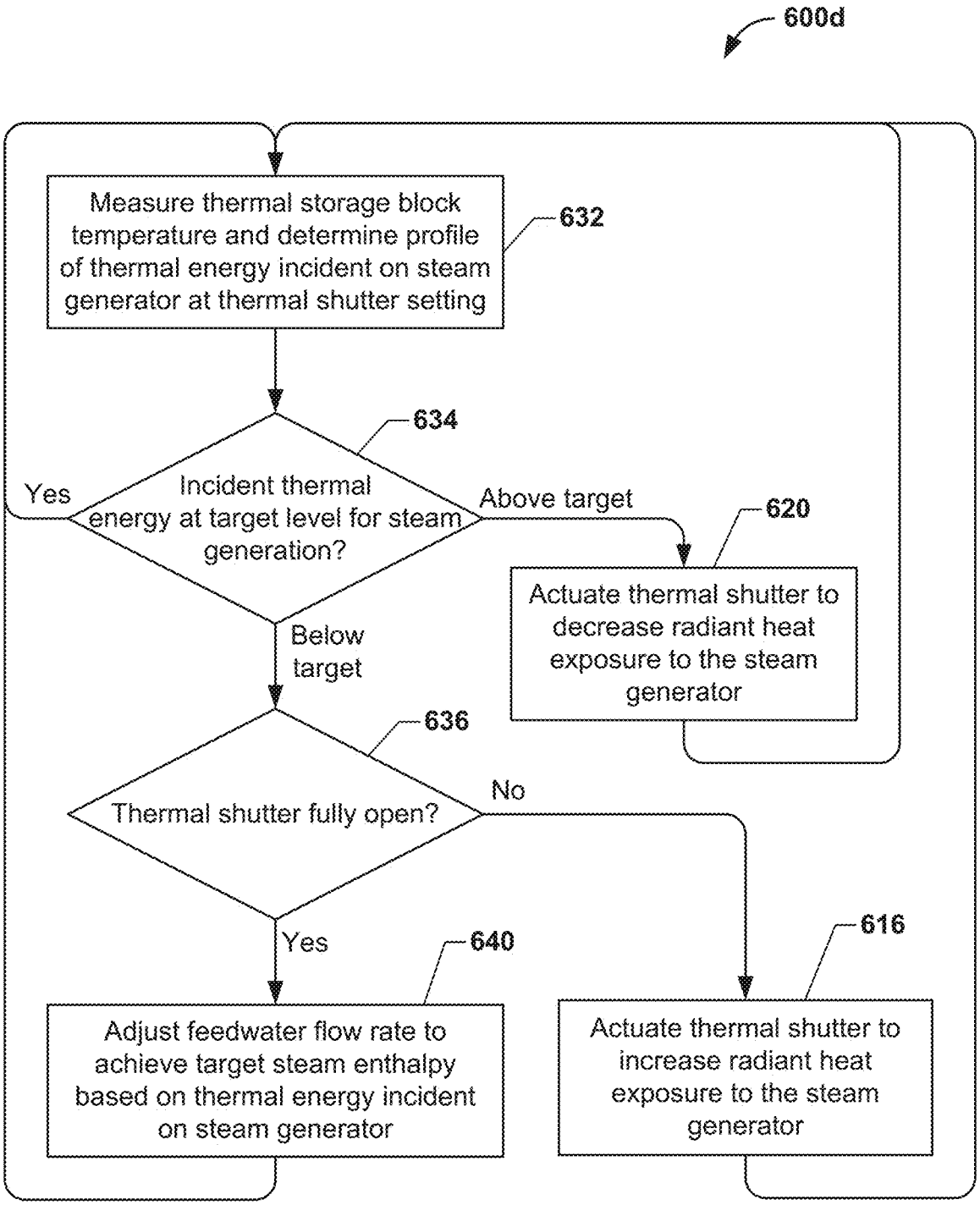
FIG. 6D is a process flow diagram illustrating an example method for controlling a thermal storage system including a steam generator to maintain a target steam enthalpy according to some embodiments.

FIG. 6D is a process flow diagram illustrating an example of a method 600*d* for controlling both the thermal storage system and flow rates of feedwater supplied to a steam generator type thermal energy receiver according to some embodiments. The method 600*d* illustrates an example of a method by which the thermal storage system may regulate the application of thermal energy to a heat exchanger to generate steam as well as feedwater flow rates to achieve a target output steam enthalpy. Means for performing functions of the method 600*d* include a computing device 150 configured to receive temperature data from various temperature sensors 140, 141, 142 within the system, and particularly sensors associated with the steam generator thermal energy receiver 130, and to send control instructions to the actuators 120 coupled to the thermal shutters 106 as well as to system elements controlling steam generator feed pumps and/or throttle valves.

In the method 600*d*, the control system may sample various temperature sensors within the thermal storage system, inlet water temperatures, outlet steam temperatures and other element temperatures to obtain information needed to determine how to adjust different system control elements to achieve the desired output steam conditions. In particular, in block 632 the control system may measure or obtain sensor readings providing the graphite thermal storage block temperature, and determine the profile of thermal energy incident on steam generator at the current thermal shutter setting (e.g., degree to which the thermal shutter is open). This may involve the control system sampling several temperature sensors coupled to or within the graphite thermal storage block to determine or calculate a temperature of the surface of the block facing the steam generator. The profile of thermal energy incident on the steam generator at the current thermal shutter setting may be determined based on the surface temperature of the graphite thermal storage block and the temperature of the steam generator surface (e.g., based on black body radiation), as well as the area of the opening through the thermal shutter. Heating of the steam generator from the temperature difference between an inert gas within the thermal storage system and the steam generator surface may also be estimated in block 632. Temperature and pressure measurements of steam exiting the steam generator may also be measured in block 632 to enable the control system to determine the enthalpy of output steam.

In determination block 634, the control system may determine whether the thermal energy incident on the steam generator is at a target level, is above the target level, or is below the target level for steam generation at the target enthalpy or target enthalpy range. The target level of thermal energy incident on the steam generator may be the amount of heat energy needed to produce steam at a target enthalpy or target enthalpy range given the current feedwater flow rate. In some embodiments, this determination may be based on the amount of incident thermal energy determined in block 632. In some embodiments, the determination may be based at least in part on measurements of the temperature and pressure of steam leaving the steam generator.

In response to determining that the thermal energy incident on the steam generator is at a target level for steam generation at the target enthalpy or target enthalpy range (i.e., determination block 634="Yes"), the control system may not change thermal shutter settings or adjust steam generator feedwater flow rates, and may continue to measure temperatures and determine thermal energy incident on the steam generator in block 632.

In response to determining that the incident thermal energy incident on the steam generator is above the target level for steam generation at the target enthalpy or target enthalpy range (i.e., determination block 618="Above target"), the control system may send control signals to actuate the thermal shutter(s) to decrease radiant heat exposure from the graphite thermal storage block to the steam generator in block 620. As described above, this may involve moving graphite plates in the thermal shutter so that the alignment of through-passages or holes with the corresponding through-passages or holes in the first graphite plate is reduced, thereby reducing the radiant heat exposure to the steam generator. In embodiments in which the thermal shutter includes three or more plates, this may involve moving two or more plates in tandem or independently to misalign or partially misalign through-passages or holes in the three or more plates. In embodiments in which the thermal shutter includes a plurality of louvers, this may involve incrementally turning the louvers to reduce the open area of the thermal shutter. In some embodiments, the thermal shutter may be actuated to decrease the radiant heat exposure to the heat exchange by an amount calculated or estimated by the control system to be sufficient to permit the target level of thermal energy to reach the heat exchanger. In some embodiments, the thermal shutter may be actuated to decrease the radiant heat exposure to the heat exchange by an incremental amount before repeating the operations in blocks 632 and 634 so that the control system incrementally adjusts the thermal shutter settings in a control loop.

In response to determining that the thermal energy incident on the steam generator is below the target level for steam generation at the target enthalpy or target enthalpy range (i.e., determination block 634="Below target"), the control system may determining whether the thermal shutter is fully open in determination block 636. Once the thermal shutter is fully open, the thermal energy incident on the heat exchanger cannot be increased.

In response to determining that the thermal shutter is not fully open (i.e., determination block 636="No"), the control system may send control signals to actuate the thermal shutter(s) to increase radiant heat exposure from the graphite thermal storage block to the steam generator in block 616, thereby increasing radiant heat exposure from the graphite thermal storage block to the steam generator. As described above, in some embodiments this may involve moving one or more graphite plates so that the through-passages or holes align or partially align with the corresponding through-passages or holes in the first graphite plate 116. In embodiments in which the thermal shutter includes three or more plates, this may involve moving two or more plates in tandem or independently to align or partially align through-passages or holes in the three or more plates. In embodiments in which the thermal shutter includes a plurality of louvers, this may involve incrementally turning the louvers to increase the open area of the thermal shutter. In some embodiments, the thermal shutter may be actuated to increase the radiant heat exposure to the heat exchange by an amount calculated or estimated to be sufficient to permit the target level of thermal energy to reach the heat exchanger. In some embodiments, the amount of movement performed in block 616 may be a fraction of the controllable displacement so that the control system incrementally increases the amount of radiant heat that reaches the steam generator in each control cycle through blocks 632, 634, 636 and 616.

In response to determining that the thermal shutter is fully open (i.e., determination block 636="Yes") and thus thermal energy incident on the steam generator cannot be increased, the control system may send control signals to a steam generator control system, feed pump controller, or other element configured to control the flow rate of water into the steam generator so as to adjust the feedwater flow rate to achieve target steam enthalpy based on thermal energy incident on steam generator. In some embodiments, the control system may adjust the feedwater flow rate to an amount calculated or estimated to result in the generation of steam at the target enthalpy or target enthalpy range based on the determined thermal energy incident on the steam generator (e.g., estimated in block 632). In some embodiments, the control system may adjust the feedwater flow rate by an increment and then measure the temperature and pressure of the resulting steam to determine whether the target enthalpy or target enthalpy range is achieved, thus incrementally adjusting the feedwater flow rate in each control cycle through blocks 632, 634, 636 and 640.

While the method **600*d* illustrated in FIG. 6D shows two determination operations performed in a sequence, this illustration is merely one example of a suitable control method. In various embodiments the determinations in blocks 634 and 636** may be performed in a different order or in a single determination operation. Further, other control methods may be implemented to control the actuation of thermal shutters and feedwater flow rate in order to control the enthalpy of steam exiting the steam generator.

Figure 7:
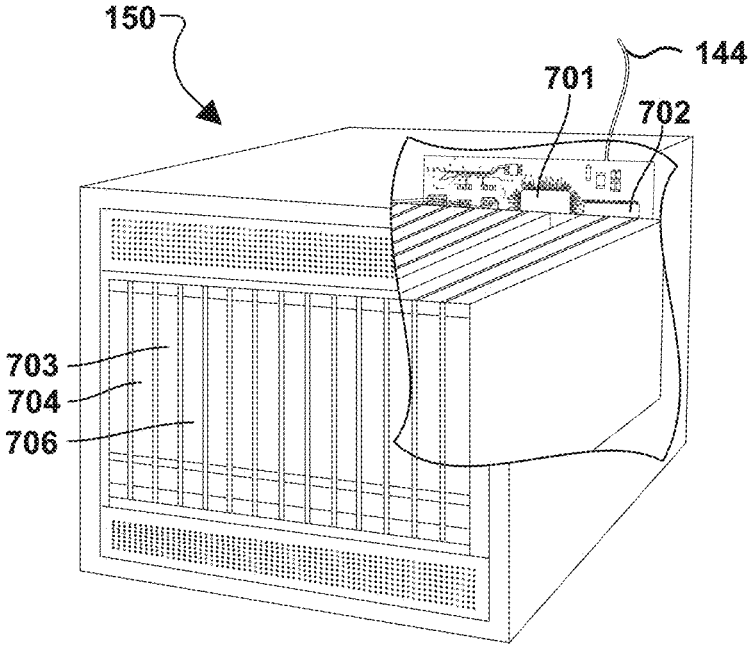
FIG. 7 is a component block diagram of an example of computing device suitable for implementing the example method illustrated in FIGS. 6A-6D.

Embodiment control methods, such as the methods **600*a*-600*d* described with reference to FIGS. 6A-6D may be implemented on any of a variety of commercially available computing devices for controlling the thermal shutters, such as the computer 150 illustrated in FIG. 7. With reference to FIGS. 1A-7, such a computer 150 typically includes a processor 701 coupled to volatile memory 702 and a large capacity nonvolatile memory, such as a disk drive 703. The computer 150 may also include a floppy disc drive, compact disc (CD), digital versatile disc (DVD) drive 706 or other non-transitory storage media coupled to the processor 701**.

The computer 150 may also include one or more network transceivers 704, such as a network access port, coupled to the processor 701 for communicating control commands to one or more thermal shutter actuators 120 as well as receive temperature data (as well as other sensor data) from one or more temperatures sensors via a local network 144.

The processor 701 of the computer 150 may be any programmable microprocessor, microcomputer or multiple processor chip or chips that can be configured by software instructions (applications) to perform a variety of functions, including the functions of various embodiments described below. Software programs implementing embodiment methods (e.g., the method 600*a*) may be stored in the memory 702, 703 before processor-executable instructions are accessed and loaded into the processor. The processor 701 may include internal memory sufficient to store the processor-executable instructions.

Some specific implementation examples according to various embodiments are described in the following paragraphs.

Example 1. A thermal storage system, including: a graphite thermal storage block configured to store energy as heat; a heating element disposed on or in the graphite thermal storage block and configured to apply thermal energy to the graphite thermal storage block; a thermal energy receiver; and a thermal shutter configured to control an amount of radiant thermal energy emitted by the graphite thermal storage block that is exposed to the thermal energy receiver.

Example 2. The thermal storage system of example 1, further including: an actuator coupled to the thermal shutter and configured to actuate the thermal shutter; and a control system coupled to the actuator, in which the control system is configured to send commands to the actuator to cause the actuator to actuate the thermal shutter so as to control the amount radiant thermal energy emitted by the graphite thermal storage block that is exposed to the thermal energy receiver.

Example 3. The thermal storage system of example 2, in which the control system is further configured to control the heating element to prevent temperatures of the graphite thermal storage block from exceeding a maximum operating temperature.

Example 4. The thermal storage system of example 2, in which the heating element includes electrical conductors electrically coupled to the graphite thermal storage block and configured to direct electricity from an external power source to flow through the graphite thermal storage block causing at least part of the graphite thermal storage block to generate heat through resistive heat, and in which the control system is further configured to control the amount of electricity flowing through the graphite thermal storage block to prevent temperatures of the graphite thermal storage block from exceeding a maximum operating temperature.

Example 5. The thermal storage system of any of examples 2-4, in which: the thermal energy receiver is a heat exchanger; and the control system is configured to send commands to the actuator to cause the actuator to actuate the thermal shutter so as to control the amount radiant thermal energy emitted by the graphite thermal storage block that is exposed to the heat exchanger to maintain a target output fluid temperature.

Example 6. The thermal storage system of any of examples 2-4, in which: the thermal energy receiver is a steam generator configured to receive feedwater and generate steam when exposed to thermal energy emitted by the graphite thermal storage block; and the control system is configured to send commands to one or both of a feedwater flow rate controller or the actuator to cause the actuator to actuate the thermal shutter so as to control a feedwater flow rate and the amount radiant thermal energy emitted by the graphite thermal storage block that is exposed to the steam generator to maintain generated steam at a target enthalpy or target enthalpy range.

Example 7. The thermal storage system of any of examples 1-6, in which: the thermal energy receiver includes a plurality of thermal energy receivers; the thermal shutter includes a plurality of thermal shutters each coupled to one of a plurality of actuators; and the control system is configured to control each of the plurality of actuators to send commands to each of the plurality of actuators to cause the plurality of actuators to actuate respective ones of the plurality of thermal shutters so as to control the amount radiant thermal energy emitted by the graphite thermal storage block exposed to respective ones of the plurality of thermal energy receivers.

Example 8. The thermal storage system of any of examples 1-7, in which the thermal shutter includes a single plate coupled to the actuator and positioned adjacent to a window in thermal insulation between the graphite thermal storage block and the thermal energy receiver, in which the single plate is configured to at least partially block transmission of thermal energy through the plate and to be moved by the actuator to cover the window in a fully closed configuration and incrementally uncover the window as the plate is moved by the actuator to a fully open configuration.

Example 9. The thermal storage system of any of examples 1-7, in which the thermal shutter includes a window closure mechanism positioned adjacent to a window in thermal insulation between the graphite thermal storage block and the thermal energy receiver, in which the window closure mechanism is configured to at least partially block transmission of thermal energy through the window in a fully closed configuration and incrementally uncover the window as the window closure mechanism is moved by the actuator to a fully open configuration.

Example 10. The thermal storage system of any of examples 1-7, in which the thermal shutter includes: a first plate positioned in the thermal storage system to face a side of the graphite thermal storage block, the first plate including a plurality of openings having a size and shape to enable radiant thermal energy to pass through the first plate; a second plate positioned in the thermal storage system between the first plate and the thermal energy receiver, the second plate including a plurality of openings having the size and shape to enable radiant thermal energy to pass through the second plate; and a drive shaft coupling the second plate to the actuator, in which the plurality of openings in the first plate and the second plate are positioned on the respective plates such that when second plate is maintained by the actuator in a first position relative to the first plate the plurality of openings in the first plate and the second plate are aligned and permit radiant thermal energy to pass through both the first and second plate, and such that when the second plate is maintained by the actuator in a second position relative to the first plate the plurality of openings in the first plate and the second plate do not align and radiant thermal energy passing through the openings in the first is blocked by the second plate so that the thermal energy exposed to the thermal energy receiver is reduced.

Example 11. The thermal storage system of any of examples 1-7, in which the thermal shutter includes: a first plate positioned in the thermal storage system to face a side of the graphite thermal storage block, the first plate including a plurality of openings having a size and shape to enable radiant thermal energy to pass through the first plate; a plurality of second plates positioned in the thermal storage system between the first plate and the thermal energy receiver, the plurality of second plates including a plurality of openings to pass through the plurality of second plates; and a plurality of drive shafts coupling the plurality of second plates to the actuator or plurality of actuators, in which the plurality of openings in the first plate and the plurality of second plates are positioned on the respective plates such that when the plurality of second plates are maintained by the actuator or actuators in a first position relative to the first plate the plurality of openings in the first plate and the plurality of second plates are aligned or partially aligned to permit radiant thermal energy to pass through both the first and the plurality of second plates, and such that when the plurality of second plates are maintained by the actuators in a second position relative to the first plate the plurality of openings in the first plate and the plurality of second plates do not align and radiant thermal energy passing through the openings in the first is blocked by the plurality of second plates so that the thermal energy exposed to the thermal energy receiver is reduced.

Example 12. The thermal storage system of any of examples 1-7, in which the thermal shutter includes: a plurality of louver plates; and at least one actuator mechanically coupled to one or more of the plurality of louver plates and configured to rotate the one or more of the plurality of louver plates so as to control the amount radiant thermal energy emitted by the graphite thermal storage block that is exposed to the thermal energy receiver.

Example 13. The thermal storage system of any of examples 1-12, in which the graphite thermal storage block includes a plurality of graphite blocks.

Example 14. The thermal storage system of any of examples 1-13, in which the thermal energy receiver is a thermionic power converter configured to convert heat energy received from the thermal storage block into electricity.

Example 15. A method for controlling a thermal storage system, including: applying energy to a graphite thermal storage block so as to store energy by raising the temperature of the graphite thermal storage block; and actuating a thermal shutter to control an amount of radiant thermal energy emitted by the graphite thermal storage block that is exposed to a thermal energy receiver.

Example 16. The method of example 15, in which actuating the thermal shutter to control the amount of radiant thermal energy emitted by the graphite thermal storage block that is exposed to a thermal energy receiver includes actuating the thermal shutter to achieve a temperature of the thermal energy receiver between a maximum temperature and a minimum temperature.

Example 17. The method of example 16, in which actuating the thermal shutter to control the amount of radiant thermal energy emitted by the graphite thermal storage block that is exposed to a thermal energy receiver includes actuating the thermal shutter to control an amount of radiant thermal energy per unit time reaching the thermal energy receiver.

Example 18. The method of example 15, in which the thermal energy receiver is a steam generator, the method further including controlling a feedwater flow rate into the steam generator in combination with actuating the thermal shutter to control an amount of radiant thermal energy per unit time reaching the thermal energy receiver so as to maintain steam produced by the steam generator at a target enthalpy or within a target range of enthalpies.

Example 19. A thermal storage system, including: a chamber including: a first subchamber, a second subchamber; and an exposure zone positioned between the first and second subchambers; a heat exchanger positioned within the exposure zone; a stack of graphite thermal storage blocks positioned within the chamber configured to store energy as heat; a thermal energy receiver; and an actuator coupled to the stack of graphite thermal storage blocks and configured to raise or lower the stack of graphite thermal storage blocks between the first subchamber and second subchamber; and a control system coupled to the actuator, in which the control system is configured to send commands to the actuator to cause the actuator to raise or lower the stack of graphite thermal storage blocks so that at least one graphite thermal storage block positioned within the exposure zone to expose the thermal energy receiver to thermal energy emitted by the at least one graphite thermal storage block.

Example 20. A method for controlling a thermal storage system, including: applying energy to a plurality of graphite thermal storage blocks within a stack of graphite thermal storage blocks positioned within a chamber so as to store energy by raising the temperature of the graphite thermal storage blocks; and controlling an actuator to raise or lower the stack of graphite thermal storage blocks so as to position at least one graphite storage block within an exposure zone within the chamber to expose a thermal energy receiver to thermal energy emitted by the at least one graphite thermal storage block.

As used in this application, the terms "component," "module," "system," and the like are intended to include a computer-related entity, such as, but not limited to, hardware, firmware, a combination of hardware and software, software, or software in execution, which are configured to perform particular operations or functions. For example, a component may be, but is not limited to, a process running on a processor, a processor, an object, an executable, a thread of execution, a program, and/or a computer. By way of illustration, both an application running on a wireless device and the wireless device may be referred to as a component. One or more components may reside within a process and/or thread of execution and a component may be localized on one processor or core and/or distributed between two or more processors or cores. In addition, these components may execute from various non-transitory computer readable media having various instructions and/or data structures stored thereon. Components may communicate by way of local and/or remote processes, function or procedure calls, electronic signals, data packets, memory read/writes, and other known network, computer, processor, and/or process related communication methodologies.

Various embodiments illustrated and described are provided merely as examples to illustrate various features of the claims. However, features shown and described with respect to any given embodiment are not necessarily limited to the associated embodiment and may be used or combined with other embodiments that are shown and described. Further, the claims are not intended to be limited by any one example embodiment. For example, one or more of the operations of the methods 600*a*-600*d* may be combined with one or more other operations or performed in an order different from that illustrated in FIGS. 600*a*-600*d*.

The foregoing method descriptions and the process flow diagrams are provided merely as illustrative examples and are not intended to require or imply that the operations of various embodiments must be performed in the order presented. As will be appreciated by one of skill in the art the order of operations in the foregoing embodiments may be performed in any order. Words such as "thereafter," "then," "next," etc. are not intended to limit the order of the operations; these words are used to guide the reader through the description of the methods. Further, any reference to claim elements in the singular, for example, using the articles "a," "an," or "the" is not to be construed as limiting the element to the singular.

Various illustrative logical blocks, modules, components, circuits, and algorithm operations described in connection with the embodiments disclosed herein may be implemented as electronic hardware, computer software, or combinations of both. To clearly illustrate this interchangeability of hardware and software, various illustrative components, blocks, modules, circuits, and operations have been described above generally in terms of their functionality. Whether such functionality is implemented as hardware or software depends upon the particular application and design constraints imposed on the overall system. Skilled artisans may implement the described functionality in varying ways for each particular application, but such embodiment decisions should not be interpreted as causing a departure from the scope of the claims.

In one or more embodiments, the functions described may be implemented in hardware, software, firmware, or any combination thereof. If implemented in software, the functions may be stored as one or more instructions or code on a non-transitory computer-readable storage medium or non-transitory processor-readable storage medium. The operations of a method or algorithm disclosed herein may be embodied in a processor-executable software module or processor-executable instructions, which may reside on a non-transitory computer-readable or processor-readable storage medium. Non-transitory computer-readable or processor-readable storage media may be any storage media that may be accessed by a computer or a processor. By way of example but not limitation, such non-transitory computer-readable or processor-readable storage media may include RAM, ROM, EEPROM, FLASH memory, CD-ROM or other optical disk storage, magnetic disk storage or other magnetic storage smart objects, or any other medium that may be used to store desired program code in the form of instructions or data structures and that may be accessed by a computer. Disk and disc, as used herein, includes compact disc (CD), laser disc, optical disc, digital versatile disc (DVD), floppy disk, and Blu-ray disc where disks usually reproduce data magnetically, while discs reproduce data optically with lasers. Combinations of the above are also included within the scope of non-transitory computer-readable and processor-readable media. Additionally, the operations of a method or algorithm may reside as one or any combination or set of codes and/or instructions on a non-transitory processor-readable storage medium and/or computer-readable storage medium, which may be incorporated into a computer program product.

The preceding description of the disclosed embodiments is provided to enable any person skilled in the art to make or use the claims. Various modifications to these embodiments will be readily apparent to those skilled in the art, and the generic principles defined herein may be applied to other embodiments without departing from the scope of the claims. Thus, the present disclosure is not intended to be limited to the embodiments shown herein but is to be accorded the widest scope consistent with the following claims and the principles and novel features disclosed herein.

What is claimed is:

1. A thermal storage system, comprising:

a chamber configured to maintain a vacuum or an inert gas atmosphere therein;

a graphite thermal storage block positioned within the chamber and configured to store energy as heat;

a heating element disposed on or in the graphite thermal storage block within the chamber and configured to apply thermal energy to the graphite thermal storage block;

a thermal energy receiver positioned within the chamber; and a thermal shutter positioned within the chamber and configured to control an amount of radiant thermal energy emitted by the graphite thermal storage block that is exposed to the thermal energy receiver.

2. The thermal storage system of claim 1, further comprising:

an actuator coupled to the thermal shutter and configured to actuate the thermal shutter; and a control system coupled to the actuator, wherein the control system is configured to send commands to the actuator to cause the actuator to actuate the thermal shutter so as to control the amount radiant thermal energy emitted by the graphite thermal storage block that is exposed to the thermal energy receiver.

3. The thermal storage system of claim 2, wherein the control system is further configured to control the heating element to prevent temperatures of the graphite thermal storage block from exceeding a maximum operating temperature.

4. The thermal storage system of claim 2, wherein:

the heating element comprises electrical conductors electrically coupled to the graphite thermal storage block and configured to direct electricity from an external power source to flow through the graphite thermal storage block causing at least part of the graphite thermal storage block to generate heat through resistive heat; and the control system is further configured to control the amount of electricity flowing through the graphite thermal storage block to prevent temperatures of the graphite thermal storage block from exceeding a maximum operating temperature.

5. The thermal storage system of claim 2, wherein:

the thermal energy receiver is a heat exchanger; and the control system is configured to send commands to the actuator to cause the actuator to actuate the thermal shutter so as to control the amount radiant thermal energy emitted by the graphite thermal storage block that is exposed to the heat exchanger to maintain a target output fluid temperature.

6. The thermal storage system of claim 2, wherein:

the thermal energy receiver is a steam generator configured to receive feedwater and generate steam when exposed to thermal energy emitted by the graphite thermal storage block; and the control system is configured to send commands to one or both of a feedwater flow rate controller or the actuator to cause the actuator to actuate the thermal shutter so as to control a feedwater flow rate and the amount radiant thermal energy emitted by the graphite thermal storage block that is exposed to the steam generator to maintain generated steam at a target enthalpy or target enthalpy range.

7. The thermal storage system of claim 2, wherein:

the thermal energy receiver comprises a plurality of thermal energy receivers;

the thermal shutter comprises a plurality of thermal shutters each coupled to one of a plurality of actuators; and the control system is configured to control each of the plurality of actuators to send commands to each of the plurality of actuators to cause the plurality of actuators to actuate respective ones of the plurality of thermal shutters so as to control the amount radiant thermal energy emitted by the graphite thermal storage block exposed to respective ones of the plurality of thermal energy receivers.

8. The thermal storage system of claim 2, wherein the thermal shutter comprises a single plate coupled to the actuator and positioned adjacent to a window in thermal insulation between the graphite thermal storage block and the thermal energy receiver, wherein the single plate is configured to at least partially block transmission of thermal energy through the plate and to be moved by the actuator to cover the window in a fully closed configuration and incrementally uncover the window as the plate is moved by the actuator to a fully open configuration.

9. The thermal storage system of claim 2, wherein the thermal shutter comprises a window closure mechanism positioned adjacent to a window in thermal insulation between the graphite thermal storage block and the thermal energy receiver, wherein the window closure mechanism is configured to at least partially block transmission of thermal energy through the window in a fully closed configuration and incrementally uncover the window as the window closure mechanism is moved by the actuator to a fully open configuration.

10. The thermal storage system of claim 2, wherein the thermal shutter comprises:

a first plate positioned in the thermal storage system to face a side of the graphite thermal storage block, the first plate comprising a plurality of openings having a size and shape to enable radiant thermal energy to pass through the first plate;

a second plate positioned in the thermal storage system between the first plate and the thermal energy receiver, the second plate comprising a plurality of openings having the size and shape to enable radiant thermal energy to pass through the second plate; and a drive shaft coupling the second plate to the actuator, wherein the plurality of openings in the first plate and the second plate are positioned on the respective plates such that when second plate is maintained by the actuator in a first position relative to the first plate the plurality of openings in the first plate and the second plate are aligned and permit radiant thermal energy to pass through both the first and second plate, and such that when the second plate is maintained by the actuator in a second position relative to the first plate the plurality of openings in the first plate and the second plate do not align and radiant thermal energy passing through the openings in the first is blocked by the second plate so that the thermal energy exposed to the thermal energy receiver is reduced.

11. The thermal storage system of claim 2, wherein the thermal shutter comprises:

a first plate positioned in the thermal storage system to face a side of the graphite thermal storage block, the first plate comprising a plurality of openings having a size and shape to enable radiant thermal energy to pass through the first plate;

a plurality of second plates positioned in the thermal storage system between the first plate and the thermal energy receiver, the plurality of second plates comprising a plurality of openings to pass through the plurality of second plates; and a plurality of drive shafts coupling the plurality of second plates to the actuator or plurality of actuators, wherein the plurality of openings in the first plate and the plurality of second plates are positioned on the respective plates such that when the plurality of second plates are maintained by the actuator or actuators in a first position relative to the first plate the plurality of openings in the first plate and the plurality of second plates are aligned or partially aligned to permit radiant thermal energy to pass through both the first and the plurality of second plates, and such that when the plurality of second plates are maintained by the actuators in a second position relative to the first plate the plurality of openings in the first plate and the plurality of second plates do not align and radiant thermal energy passing through the openings in the first is blocked by the plurality of second plates so that the thermal energy exposed to the thermal energy receiver is reduced.

12. The thermal storage system of claim 2, wherein the thermal shutter comprises:

a plurality of louver plates; and at least one actuator mechanically coupled to one or more of the plurality of louver plates and configured to rotate the one or more of the plurality of louver plates so as to control the amount radiant thermal energy emitted by the graphite thermal storage block that is exposed to the thermal energy receiver.

13. The thermal storage system of claim 1, wherein the graphite thermal storage block comprises a plurality of graphite blocks.

14. The thermal storage system of claim 1, wherein the thermal energy receiver is a thermionic power converter configured to convert heat energy received from the graphite thermal storage block into electricity.

15. A thermal storage system, comprising:

a chamber comprising:

a first subchamber, a second subchamber; and an exposure zone positioned between the first and second subchambers;

a heat exchanger positioned within the exposure zone;

a stack of graphite thermal storage blocks positioned within the chamber configured to store energy as heat;

a thermal energy receiver;

an actuator coupled to the stack of graphite thermal storage blocks and configured to raise or lower the stack of graphite thermal storage blocks between the first subchamber and the second subchamber; and a control system coupled to the actuator, wherein the control system is configured to send commands to the actuator to cause the actuator to raise or lower the stack of graphite thermal storage blocks so that at least one graphite thermal storage block positioned within the exposure zone to expose the thermal energy receiver to thermal energy emitted by the at least one graphite thermal storage block.

* * * * *